US009211574B2

(12) United States Patent
Akashi et al.

(10) Patent No.: US 9,211,574 B2
(45) Date of Patent: Dec. 15, 2015

(54) METHOD FOR MANUFACTURING STEEL SHEET

(71) Applicants: Tooru Akashi, Tokyo (JP); Takeo Itoh, Tokyo (JP); Daisuke Kasai, Tokyo (JP); Shigeru Ogawa, Tokyo (JP); Shingo Kuriyama, Tokyo (JP)

(72) Inventors: Tooru Akashi, Tokyo (JP); Takeo Itoh, Tokyo (JP); Daisuke Kasai, Tokyo (JP); Shigeru Ogawa, Tokyo (JP); Shingo Kuriyama, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 74 days.

(21) Appl. No.: 14/111,959

(22) PCT Filed: Dec. 6, 2012

(86) PCT No.: PCT/JP2012/081634

§ 371 (c)(1),
(2) Date: Oct. 15, 2013

(87) PCT Pub. No.: WO2014/087516

PCT Pub. Date: Jun. 12, 2014

(65) Prior Publication Data

US 2014/0076018 A1 Mar. 20, 2014

(30) Foreign Application Priority Data

Jul. 27, 2011 (JP) ..... 2011-164032
Jul. 5, 2012 (JP) ..... 2012-151025

(51) Int. Cl.
*B21B 1/26* (2006.01)
*B21B 37/44* (2006.01)
(Continued)

(52) U.S. Cl.
CPC . *B21B 1/26* (2013.01); *B21B 37/32* (2013.01); *B21B 37/44* (2013.01); *B21B 37/76* (2013.01);
(Continued)

(58) Field of Classification Search
CPC ..... B21B 1/26; B21B 37/26; B21B 37/32; B21B 37/44; B21B 37/76; B21B 2263/06; B21B 2236/04; B21B 38/006; B21B 38/02
USPC ..... 72/201, 8.1, 8.5, 11.3; 700/153
See application file for complete search history.

(56) References Cited

U.S. PATENT DOCUMENTS 4,047,985 A * 9/1977 Greenberger ..... 134/15
4,274,273 A * 6/1981 Fapiano et al. ..... 72/8.5
(Continued)

FOREIGN PATENT DOCUMENTS

CN 101780478 7/2010
CN 102166582 8/2011
(Continued)

OTHER PUBLICATIONS

High Strength and Ultra High Strength Steels for Weight Reduction in Structural and Safety Related Applications 29th Int. Symposium on Automotive Technology &Automation (ISATA) Florens, Jun. 1996 by Jan-Olof Sperle and Kennet Olsson.*
(Continued)

*Primary Examiner* — Peter DungBa Vo
*Assistant Examiner* — Joshua D Anderson
(74) *Attorney, Agent, or Firm* — Kenyon & Kenyon LLP

(57) ABSTRACT

A method for manufacturing a steel sheet of the invention includes a hot-rolling process in which a steel material is hot-rolled using a finishing mill so as to obtain a hot-rolled steel sheet; and a cooling process in which the hot-rolled steel sheet is cooled. The hot-rolling process includes a target steepness-setting process in which a target steepness of the edge wave shape is set based on first correlation data indicating a correlation between a steepness of the edge wave shape of the hot-rolled steel sheet and a temperature standard deviation Y; and a shape-controlling process in which operation parameters of the finishing mill are controlled so as to match the steepness of the edge wave shape with the target steepness.

3 Claims, 11 Drawing Sheets

(51) Int. Cl.

| | |
|---|---|
| ***B21B 37/32*** | (2006.01) |
| ***B21B 37/76*** | (2006.01) |
| *B21B 45/02* | (2006.01) |
| *B21B 38/02* | (2006.01) |
| *B21B 37/28* | (2006.01) |
| *B21B 38/00* | (2006.01) |

(52) U.S. Cl.
CPC ..... *B21B 37/28* (2013.01); *B21B 38/006* (2013.01); *B21B 38/02* (2013.01); *B21B 45/0218* (2013.01); *B21B 2263/06* (2013.01)

(56) References Cited

U.S. PATENT DOCUMENTS

| | | | | |
|---|---|---|---|---|
| 4,726,213 | A * | 2/1988 | Manchu | 72/9.1 |
| 5,259,229 | A | 11/1993 | Inagaki et al. | |
| 6,615,633 | B1 * | 9/2003 | Akashi et al. | 72/200 |
| 7,577,489 | B2 * | 8/2009 | Fodor et al. | 700/154 |
| 2010/0132426 | A1 * | 6/2010 | Baumgartel et al. | 72/342.2 |
| 2012/0318478 | A1 * | 12/2012 | Weinzierl | 165/104.11 |
| 2014/0053886 | A1 * | 2/2014 | Akashi et al. | 134/57 R |
| 2014/0060139 | A1 * | 3/2014 | Akashi et al. | 72/201 |

FOREIGN PATENT DOCUMENTS

| | | |
|---|---|---|
| CN | 102481610 | 5/2012 |
| CN | 102596440 | 7/2012 |
| CN | 102781598 | 11/2012 |
| JP | 02-075409 | 3/1990 |
| JP | 02-179819 | 7/1990 |
| JP | 02-179825 | 7/1990 |
| JP | 03-018416 | 1/1991 |
| JP | 05-337505 | 12/1993 |
| JP | 06-228651 | 8/1994 |
| JP | 06-228652 | 8/1994 |
| JP | 06-228653 | 8/1994 |
| JP | 06-328117 | 11/1994 |
| JP | 7-63750 | 7/1995 |
| JP | 07-214133 | 8/1995 |
| JP | 10-166023 | 6/1998 |
| JP | 10-263696 | 10/1998 |
| JP | 11-347629 | 12/1999 |
| JP | 2000-001719 | 1/2000 |
| JP | 2000-317513 | 11/2000 |
| JP | 2002-045908 | 2/2002 |
| JP | 2003-048003 | 2/2003 |
| JP | 2005-066614 | 3/2005 |
| JP | 2005-074463 | 3/2005 |
| JP | 3657750 | 6/2005 |
| JP | 2005-271052 | 10/2005 |
| JP | 2006-272441 | 10/2006 |
| JP | 2006-281271 | 10/2006 |
| JP | 2007-216246 | 8/2007 |
| JP | 4029871 | 1/2008 |
| JP | 2009-208086 | 9/2009 |
| JP | 2010-105027 | 5/2010 |
| JP | 2011-073054 | 4/2011 |
| TW | 1315683 | 10/2009 |
| WO | 2009/011070 | 1/2009 |
| WO | WO 2011104103 A2 * | 9/2011 |

OTHER PUBLICATIONS

International Search Report dated Jan. 22, 2013 issued in PCT Application No. PCT/JP2012/081670 [With English Translation].
International Search Report dated Jan. 22, 2013 issued in PCT Application No. PCT/JP2012/081659 [With English Translation].
International Search Report dated Jan. 22, 2013 issued in corresponding PCT Application No. PCT/JP2012/081634 [With English Translation].
Office Action dated Apr. 23, 2013 from corresponding Japanese Application No. 2012-128595 [With English Translation].
Notice of Allowance dated Oct. 7, 2014 from corresponding Japanese Application No. 2012-128595 [with English Translation].
Office Action dated Oct. 28, 2014 from corresponding Korean Application No. 10-2013-7019174 [with English Translation].
Office Action dated Dec. 3, 2013 from corresponding Japanese Application No. 2011-127154 [With English Translation].
Office Action dated Jan. 6, 2014 from corresponding Japanese Application No. 2012-128595 [With English Translation].
Office Action dated Jan. 6, 2014 from corresponding Japanese Application No. 2012-151025 [With English Translation].
Notice of Allowance dated Apr. 3, 2015 issued in corresponding Korean Application No. 10-2013-7019174 [with English Translation].
Notice of Allowance dated Dec. 30, 2014 from corresponding Taiwanese Application No. 101146085 [with English Translation].
Office Action dated Feb. 3, 2015 from corresponding Chinese Application No. 201280007157.6 [with English Translation of Search Report].
Office Action dated Feb. 27, 2015 issued in corresponding CN Application No. 201280005604.4.
Office Action dated Mar. 17, 2015 issued in corresponding CN Application No. 201280010631.0.
Office Action dated Jun. 9, 2015 issued in corresponding Taiwanese Application No. 101146092 [with English Translation].

* cited by examiner

PRIOR ART

METHOD FOR MANUFACTURING STEEL SHEET

This application is a national stage application of International Application No. PCT/JP2012/081634, filed Dec. 6, 2012, which claims priority to Japanese Application Nos. 2011-164032, filed Jul. 27, 2011; and 2012-151025, filed Jul. 5, 2012, each of which is incorporated by reference in its entirety.

TECHNICAL FIELD

The present invention relates to a method for manufacturing a steel sheet.

BACKGROUND ART

For example, a hot-rolled steel sheet used in cars, industrial machines and the like is generally manufactured through a rough-rolling process and a finish-rolling process. FIG. 18 is a view schematically illustrating a method for manufacturing a hot-rolled steel sheet of the related art. In the process for manufacturing a hot-rolled steel sheet, first, a slab S obtained by continuously casting molten steel having an adjusted predetermined composition is rolled using a roughing mill 101, and then, furthermore, hot-rolled using a finishing mill 103 constituted by a plurality of rolling stands 102*a* to 102*d*, thereby forming a hot-rolled steel sheet H having a predetermined thickness. In addition, the hot-rolled steel sheet H is cooled using cooling water supplied from a cooling apparatus 111, and then coiled into a coil shape using a coiling apparatus 112.

The cooling apparatus 111 is generally a facility for carrying out so-called laminar cooling on the hot-rolled steel sheet H transported from the finishing mill 103. The cooling apparatus 111 sprays the cooling water on the top surface of the hot-rolled steel sheet H moving on a run-out table from the top in the vertical direction in a water jet form through a cooling nozzle, and, simultaneously, sprays the cooling water on the bottom surface of the hot-rolled steel sheet H through a pipe laminar in a water jet form, thereby cooling the hot-rolled steel sheet H.

In addition, for example, Patent Document 1 discloses a technique of the related art which reduces the difference in surface temperature between the top and bottom surfaces of a thick steel sheet, thereby preventing the shape of the steel sheet from becoming defective. According to the technique disclosed in Patent Document 1, the water volume ratio of cooling water supplied to the top surface and the bottom surface of the steel sheet is adjusted based on the difference in surface temperature obtained by simultaneously measuring the surface temperatures of the top surface and the bottom surface of the steel sheet using a thermometer when the steel sheet is cooled using a cooling apparatus.

In addition, for example, Patent Document 2 discloses a technique that measures the steepness at the tip of a steel sheet using a steepness meter installed on the exit side of a mill, and prevents the steel sheet from being perforated by adjusting the flow rate of cooling water to be different in the width direction based on the measured steepness.

Furthermore, for example, Patent Document 3 discloses a technique that aims to solve distribution of a wave-shaped sheet thickness in the sheet width direction of a hot-rolled steel sheet and to make uniform the sheet thickness in the sheet width direction, and controls the difference between the maximum heat transmissibility and the minimum heat transmissibility in the sheet width direction of the hot-rolled steel sheet to be in a range of predetermined values.

PRIOR ART DOCUMENT

Patent Document

[Patent Document 1] Japanese Unexamined Patent Application, First Publication No. 2005-74463

[Patent Document 2] Japanese Unexamined Patent Application, First Publication No. 2005-271052

[Patent Document 3] Japanese Unexamined Patent Application, First Publication No. 2003-48003

SUMMARY OF THE INVENTION

Problem that the Invention is to Solve

Here, there are cases in which the hot-rolled steel sheet H manufactured using the manufacturing method of the related art described using FIG. 18 forms a wave shape in the rolling direction (the arrow direction in FIG. 19) on transportation rolls 120 in the run-out table (hereinafter sometimes referred to as "ROT") in the cooling apparatus 111 as illustrated in FIG. 19. In this case, the top surface and the bottom surface of the hot-rolled steel sheet H are not uniformly cooled, and temperature variation is caused. As a result, in a steel sheet-cooling process after a hot-rolling process, a variation in the material qualities (that is, hardness of the steel sheet) is caused by the temperature variation. Furthermore, in a cold-rolling process which is a post process, a change in a sheet thickness is caused by the variation of the material qualities. In a case in which the change in the sheet thickness of the steel sheet exceeds a predetermined criterion value, the steel sheet is determined to be a defective product in an inspection process, which causes a problem of a significant decrease in yield.

However, in the cooling method of Patent Document 1, a case of a hot-rolled steel sheet having a wave shape in the rolling direction is not taken into consideration. That is, in Patent Document 1, since a surface height varies depending on a location of the wave of the hot-rolled steel sheet, a difference in the standard deviation of temperature in the rolling direction is not taken into consideration. Therefore, in the cooling method of Patent Document 1, the occurrence of the variation in the material qualities during cooling of the hot-rolled steel sheet caused by the wave shape formed in the hot-rolled steel sheet is not taken into consideration.

In addition, in the cooling method of Patent Document 2, the steepness of the steel sheet in the width direction is measured, and the flow rate of cooling water at a portion with a high steepness is adjusted. However, even in Patent Document 2, a case of a hot-rolled steel sheet having a wave shape in a rolling direction is not taken into consideration, and a fact that a variation in the material qualities during cooling of the hot-rolled steel sheet is caused by the wave shape formed in the hot-rolled steel sheet as described above is not taken into consideration.

In addition, the cooling of Patent Document 3 is the cooling of a hot-rolled steel sheet immediately before roll biting in the finishing mill, and therefore it is not possible to apply the cooling to a hot-rolled steel sheet which has undergone finish-rolling so as to have a predetermined thickness. Furthermore, Patent Document 3 also does not take a hot-rolled steel sheet having a wave shape in the rolling direction into consideration, and does not consider the occurrence of variation in the material qualities during cooling due to the wave shape formed in the hot-rolled steel sheet as described above.

The present invention has been made in consideration of the above problems, and an object of the present invention is to provide a method for manufacturing a steel sheet in which an improvement of yield of a steel sheet manufactured through at least a hot-rolling process and a cooling process can be realized.

Means for Solving the Problems

The invention employs the following means for solving the problems and achieving the relevant object.

That is, (1) A method for manufacturing a steel sheet according to an aspect of the present invention includes a hot-rolling process in which a steel material is hot-rolled using a finishing mill so as to obtain a hot-rolled steel sheet having an edge wave shape with a wave height periodically changing in a rolling direction; and a cooling process in which the hot-rolled steel sheet is cooled in a cooling section provided on a sheet-threading path, in which the hot-rolling process includes a target steepness-setting process in which a target steepness of the edge wave shape is set based on first correlation data indicating a correlation between a steepness of the edge wave shape of the hot-rolled steel sheet and a temperature standard deviation Y during or after cooling of the hot-rolled steel sheet, which have been experimentally obtained in advance; and a shape-controlling process in which operation parameters of the finishing mill are controlled so as to match the steepness of the edge wave shape with the target steepness.

(2) In the method for manufacturing a steel sheet according to the above (1), in the target steepness-setting process, the target steepness may be set in a range of more than 0% to 1%.

(3) In the method for manufacturing a steel sheet according to the above (1) or (2), the cooling process may include a target ratio-setting process in which a top and bottom heat transfer coefficient ratio X1, at which a temperature standard deviation Y becomes a minimum value Ymin, is set as a target ratio Xt based on second correlation data indicating a correlation between a top and bottom heat transfer coefficient ratio X, which is a ratio of heat transfer coefficients of top and bottom surfaces of the hot-rolled steel sheet, and the temperature standard deviation Y during or after cooling of the hot-rolled steel sheet, which have been experimentally obtained in advance under conditions in which steepness and sheet-threading speed of the hot-rolled steel sheet are set to constant values; and a cooling control process in which at least one of an amount of heat dissipated from a top surface by cooling and an amount of heat dissipated from a bottom surface by cooling of the hot-rolled steel sheet in the cooling section is controlled so that the top and bottom heat transfer coefficient ratio X of the hot-rolled steel sheet in the cooling section matches the target ratio Xt.

(4) In the method for manufacturing a steel sheet according to the above (3), in the target ratio-setting process, a top and bottom heat transfer coefficient ratio X at which the temperature standard deviation Y converges in a range of the minimum value Ymin to the minimum value Ymin+10° C. may be set as the target ratio Xt based on the second correlation data.

(5) In the method for manufacturing a steel sheet according to the above (3), the second correlation data may be prepared respectively for a plurality of conditions in which values of the steepness and the sheet-threading speed are different, and, in the target ratio-setting process, the target ratio Xt may be set based on second correlation data matching actual measured values of the steepness and the sheet-threading speed among the plurality of second correlation data.

(6) In the method for manufacturing a steel sheet according to the above (3), the second correlation data may be data indicating the correlation between the top and bottom heat transfer coefficient ratio X and the temperature standard deviation Y using a regression formula.

(7) In the method for manufacturing a steel sheet according to the above (6), the regression formula may be derived using linear regression.

(8) In the method for manufacturing a steel sheet according to the above (3), the second correlation data may be data indicating the correlation between the top and bottom heat transfer coefficient ratio X and the temperature standard deviation Y using a table.

(9) The method for manufacturing a steel sheet according to the above (3) may further include a temperature-measuring process in which a temperature of the hot-rolled steel sheet is measured in chronological order on a downstream side of the cooling section; an average temperature value-computing process in which a chronological average value of the temperature is computed based on measurement results of the temperature; and an amount of heat dissipated by cooling-adjusting process in which a total value of the amount of heat dissipated from the top surface by cooling and the amount of heat dissipated from the bottom surface by cooling of the hot-rolled steel sheet in the cooling section is adjusted so that the chronological average value of the temperature matches a predetermined target temperature.

(10) The method for manufacturing a steel sheet according to the above (3) may further include a temperature-measuring process in which a temperature of the hot-rolled steel sheet is measured in chronological order on a downstream side of the cooling section; a changing speed-measuring process in which a changing speed of the hot-rolled steel sheet in a vertical direction is measured in chronological order at a same place as a temperature measurement place of the hot-rolled steel sheet on the downstream side of the cooling section; a control direction-determining process in which, when an upward side of the vertical direction of the hot-rolled steel sheet is set as positive, in an area with a positive changing speed, in a case in which a temperature of the hot-rolled steel sheet is lower than an average temperature in a range of one or more cycles of a wave shape of the hot-rolled steel sheet, at least one of a direction in which the amount of heat dissipated from the top surface by cooling decreases and a direction in which the amount of heat dissipated from the bottom surface by cooling increases is determined as a control direction, in a case in which the temperature of the hot-rolled steel sheet is higher than the average temperature, at least one of a direction in which the amount of heat dissipated from the top surface by cooling increases and a direction in which the amount of heat dissipated from the bottom surface by cooling decreases is determined as the control direction, and, in an area with a negative changing speed, in a case in which the temperature of the hot-rolled steel sheet is lower than the average temperature, at least one of a direction in which the amount of heat dissipated from the top surface by cooling increases and a direction in which the amount of heat dissipated from the bottom surface by cooling decreases is determined as the control direction, in a case in which the temperature of the hot-rolled steel sheet is higher than the average temperature, at least one of a direction in which the amount of heat dissipated from the top surface by cooling decreases and a direction in which the amount of heat dissipated from the bottom surface by cooling increases is determined as the control direction; and an amount of heat dissipated by cooling-adjusting process in which at least one of the amount of heat dissipated from the top surface by cooling and the amount of heat dissipated from the bottom surface by cooling of the hot-rolled steel sheet in the cooling section is adjusted based on the control direction determined in the control direction-determining process.

(11) In the method for manufacturing a steel sheet according to the above (10), the cooling section may be divided into a plurality of divided cooling sections in a sheet-threading direction of the hot-rolled steel sheet, the temperature and the changing speed of the hot-rolled steel sheet may be measured in chronological order at each of borders of the divided cooling sections in the temperature-measuring process and the changing speed-measuring process, increase and decrease directions of the amounts of heat dissipated by cooling from the top and bottom surfaces of the hot-rolled steel sheet may be determined for the respective divided cooling sections based on measurement results of the temperature and the changing speeds of the hot-rolled steel sheet at the respective borders of the divided cooling sections in the control direction-determining process, and feedback control or feedforward control may be carried out in order to adjust at least one of the amount of heat dissipated from the top surface by cooling and the amount of heat dissipated from the bottom surface by cooling of the hot-rolled steel sheet at each of the divided cooling sections based on the control direction determined for each of the divided cooling sections in the amount of heat dissipated by cooling-adjusting process.

(12) The method for manufacturing a steel sheet according to the above (11) may further include a measuring process in which the steepness or the sheet-threading speed of the hot-rolled steel sheet is measured at each of the borders of the divided cooling sections; and an amount of heat dissipated by cooling-correcting process in which at least one of the amount of heat dissipated from the top surface by cooling and the amount of heat dissipated from the bottom surface by cooling of the hot-rolled steel sheet is corrected at each of the divided cooling sections based on measurement results of the steepness or the sheet-threading speeds.

(13) The method for manufacturing a steel sheet according to the above (3) may further include a post-cooling process in which the hot-rolled steel sheet is further cooled in order to make the temperature standard deviation of the hot-rolled steel sheet fall into a permissible range on a downstream side of the cooling section.

(14) In the method for manufacturing a steel sheet according to the above (3), the sheet-threading speed of the hot-rolled steel sheet in the cooling section may be set in a range of 550 m/min to a mechanical limit speed.

(15) In the method for manufacturing a steel sheet according to the above (14), a tensile strength of the hot-rolled steel sheet may be 800 MPa or more.

(16) In the method for manufacturing a hot-rolled steel sheet according to the above (14), the finishing mill may be constituted by a plurality of rolling stands, and a supplementary cooling process in which the hot-rolled steel sheet is supplementarily cooled between the plurality of the rolling stands may be further provided.

(17) In the method for manufacturing a steel sheet according to the above (3), a top side cooling apparatus having a plurality of headers that ejects cooling water to a top surface of the hot-rolled steel sheet and a bottom side cooling apparatus having a plurality of headers that ejects cooling water to a bottom surface of the hot-rolled steel sheet may be provided in the cooling section, and the amount of heat dissipated from the top surface by cooling and the amount of heat dissipated from the bottom surface by cooling may be adjusted by carrying out on-off control of the respective headers.

(18) In the method for manufacturing a steel sheet according to the above (3), a top side cooling apparatus having a plurality of headers that sprays cooling water to a top surface of the hot-rolled steel sheet and a bottom side cooling apparatus having a plurality of headers that sprays cooling water to a bottom surface of the hot-rolled steel sheet may be provided in the cooling section, and the amount of heat dissipated from the top surface by cooling and the amount of heat dissipated from the bottom surface by cooling may be adjusted by controlling at least one of sprayed water density, pressure and water temperature of each of the headers.

(19) In the method for manufacturing a steel sheet according to the above (3), cooling in the cooling section may be carried out at a temperature of the hot-rolled steel sheet in a range of 600° C. or higher.

Effect of the Invention

As a result of thorough investigation of the relation between the wave shape formed in the hot-rolled steel sheet obtained from the hot-rolling process and the temperature standard deviation during or after the cooling of the hot-rolled steel sheet, the present inventors found that, when the wave shape of the hot-rolled steel sheet is controlled to be an edge wave shape, it is possible to control the temperature standard deviation of the hot-rolled steel sheet to an arbitrary value according to the steepness of the edge wave shape.

That is, according to the present invention, in the hot-rolling process, when the target steepness of the edge wave shape is set based on the first correlation data indicating the correlation between the steepness of the edge wave shape of the hot-rolled steel sheet and the temperature standard deviation Y during or after cooling of the hot-rolled steel sheet, which have been experimentally obtained in advance, and the finishing mill is controlled so as to match the steepness of the edge wave shape formed in the hot-rolled steel sheet with the target steepness, it is possible to suppress the temperature standard deviation of the cooled hot-rolled steel sheet at a low level (the hot-rolled steel sheet can be uniformly cooled).

As a result, it is possible to suppress the occurrence of material quality variation in the cooled hot-rolled steel sheet, and therefore it is possible to improve the yield by suppressing the sheet thickness change of the steel sheet finally obtained through the cold-rolling process which is a post process.

EMBODIMENT OF THE INVENTION

Hereinafter, as an embodiment of the present invention, a method for manufacturing a steel sheet used in, for example, cars and industrial machines will be described in detail with reference to the accompanying drawings.

Figure 1:
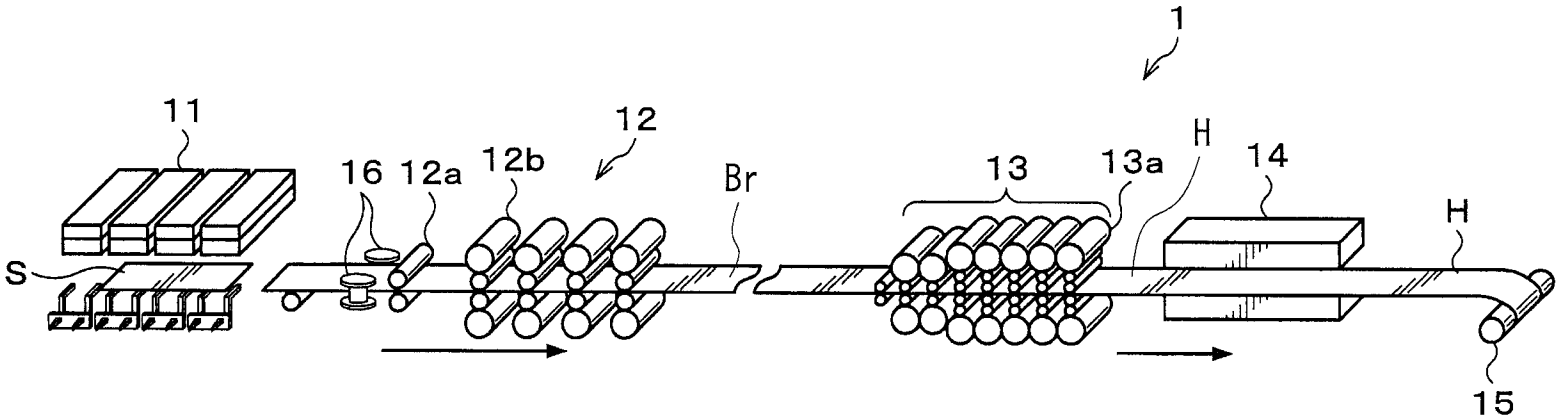
FIG. 1 is an explanatory view illustrating a hot rolling facility 1 for realizing a method for manufacturing a steel sheet in an embodiment of the present invention.

FIG. 1 schematically illustrates an example of a hot rolling facility 1 for realizing the method for manufacturing a steel sheet in the present embodiment. The hot rolling facility 1 is a facility having an aim of sandwiching the top and bottom of a heated slab S using rolls and continuously rolling the slab so as to manufacture a steel sheet having a sheet thickness of a minimum of 1.2 mm (hot-rolled steel sheet H described below) and coil the steel sheet.

The hot rolling facility 1 has a heating furnace 11 for heating the slab S, a width-direction mill 16 that rolls the slab S heated in the heating furnace 11 in a width direction, a roughing mill 12 that rolls the slab S rolled in the width direction from the vertical direction so as to produce a rough bar Br, a finishing mill 13 that continuously hot-finishing-rolls the rough bar Br so as to form a steel sheet having a predetermined sheet thickness (hereinafter referred to as hot-rolled steel sheet) H, a cooling apparatus 14 that cools the hot-rolled steel sheet H transported from the finishing mill 13 using cooling water, and a coiling apparatus 15 that coils the hot-rolled steel sheet H cooled using the cooling apparatus 14 into a coil shape.

The heating furnace 11 is provided with a side burner, an axial burner and a roof burner that heat the slab S brought from the outside through a charging hole by blowing a flame. The slab S brought into the heating furnace 11 is sequentially heated in respective heating areas formed in respective zones, and, furthermore, a heat-retention treatment for enabling transportation at an optimal temperature is carried out by uniformly heating the slab S using the roof burner in a soaking area formed in a final zone. When a heating treatment in the heating furnace 11 completely ends, the slab S is transported to the outside of the heating furnace 11, and moved into a rolling process by the roughing mill 12.

The roughing mill 12 passes the transported slab S through gaps between columnar rotary rolls provided across a plurality of stands. For example, the roughing mill 12 hot-rolls the slab S only using work rolls 12*a* provided at the top and bottom of a first stand so as to form a rough bar Br. Next, the rough bar Br which has passed through the first stand is further continuously rolled using a plurality of fourfold mills 12*b* constituted by a work roll and a back-up roll. As a result, when the rough-rolling process ends, the rough bar Br is rolled into a thickness of approximately 30 mm to 60 mm, and transported to the finishing mill 13.

The finishing mill 13 hot-finishing-rolls the rough bar Br transported from the roughing mill 12 until the thickness becomes approximately several millimeters. The finishing mill 13 passes the rough bar Br through gaps between top and bottom finish-rolling rolls 13*a* linearly arranged across 6 to 7 stands so as to gradually reduce the rough bar, thereby forming the hot-rolled steel sheet H having a predetermined sheet thickness. The hot-rolled steel sheet H formed using the finishing mill 13 is transported to the cooling apparatus 14 using the transportation rolls 32 described below. Meanwhile, an edge wave shape is formed in the rolling direction of the hot-rolled steel sheet H by the finishing mill 13.

Figure 2:
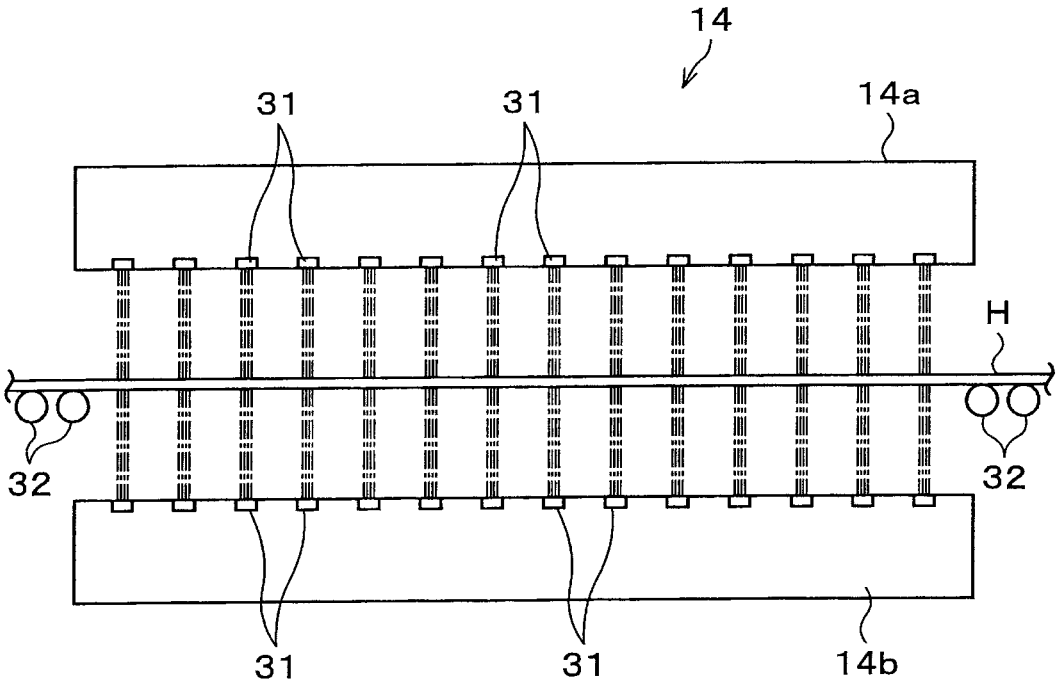
FIG. 2 is an explanatory view illustrating an outline of a configuration of a cooling apparatus 14 provided in the hot rolling facility 1.

The cooling apparatus 14 is a facility for carrying out cooling by lamination or spraying on the hot-rolled steel sheet H transported from the finishing mill 13. As illustrated in FIG. 2, the cooling apparatus 14 has a top side cooling apparatus 14*a* that sprays cooling water from cooling holes 31 on the top side to the top surface of the hot-rolled steel sheet H moving on the transportation rolls 32 in a run-out table, and a bottom side cooling apparatus 14*b* that sprays cooling water from cooling holes 31 on the bottom side to the bottom surface of the hot-rolled steel sheet H. A plurality of the cooling holes 31 is provided in the top side cooling apparatus 14*a* and the bottom side cooling apparatus 14*b* respectively.

In addition, a cooling header (not shown) is connected to the cooling hole 31. The number of the cooling holes 31 determines the cooling capabilities of the top side cooling apparatus 14*a* and the bottom side cooling apparatus 14*b*. Meanwhile, the cooling apparatus 14 may be constituted by at least one of a top and bottom split laminar, a pipe laminar, spray cooling and the like. In addition, a section in which the hot-rolled steel sheet H is cooled using the cooling apparatus 14 corresponds to a cooling section in the present invention.

The coiling apparatus 15 coils the cooled hot-rolled steel sheet H transported from the cooling apparatus 14 at a predetermined coiling temperature as illustrated in FIG. 1. The hot-rolled steel sheet H coiled into a coil shape using the coiling apparatus 15 is transported to a cold-rolling facility, not shown, cold-rolled, and prepared into a steel sheet satisfying specifications as a final product.

In the cooling apparatus 14 in the hot rolling facility 1 configured as described above, in a case in which the hot-rolled steel sheet H having the wave shape with the surface height (wave height) changing in the rolling direction is cooled, as described above, the hot-rolled steel sheet H is uniformly cooled by preferably adjusting the sprayed water density, pressure, water temperature and the like of cooling water sprayed from the top side cooling device 14*a* and cooling water sprayed from the bottom side cooling device 14*b*. However, particularly, in a case in which the sheet-threading speed is slow, a period of time during which the hot-rolled steel sheet H and the transportation rolls 32 locally come into contact with each other becomes long, and the contact portions of the hot-rolled steel sheet H with the transportation rolls 32 of the hot-rolled steel sheet H become easily coolable due to heat dissipation by contact, and therefore cooling becomes ununiform.

Figure 3:
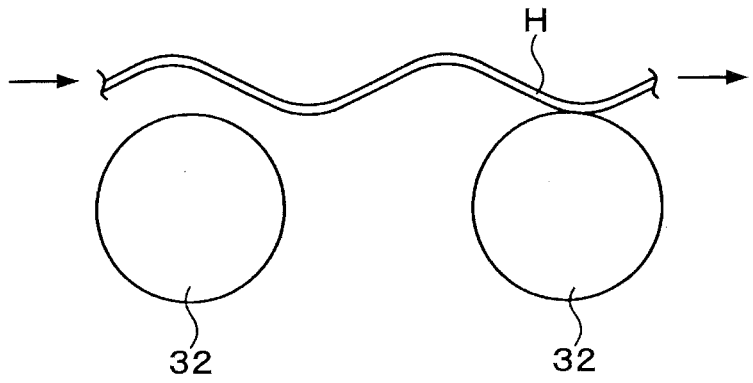
FIG. 3 is an explanatory view illustrating a shape in which a bottom point of the hot-rolled steel sheet H comes into contact with a transportation roll 32.

As illustrated in FIG. 3, in a case in which the hot-rolled steel sheet H has a wave shape, there are cases in which the hot-rolled steel sheet H locally comes into contact with the transportation rolls 32 at the bottom portion of the wave shape. As such, in the hot-rolled steel sheet H, the portions that locally come into contact with the transportation rolls 32 become more easily cooled than other portions due to heat dissipation by contact. Therefore, the hot-rolled steel sheet H is ununiformly cooled.

Meanwhile, as described above, in the hot rolling facility 1, in a case in which the hot-rolled steel sheet H is not uniformly cooled due to the wave shape formed in the hot-rolled steel sheet H, variation in the material qualities (hardness and the like) of the cooled hot-rolled steel sheet H is caused. As a result, when the hot-rolled steel sheet H is cold-rolled using the cold-rolling facility, a change in the sheet thickness is caused in a steel sheet obtained as a final product (steel sheet product). Since the change in the sheet thickness of the steel sheet product causes a decrease in yield, it is necessary to suppress the change in the sheet thickness at a level at which the steel sheet product is not determined as a defective product in an inspection process. Therefore, the inventors carried out a verification process described below in order to investigate the relationship between the wave shape formed in the hot-rolled steel sheet H and a change in the sheet thickness in the post process (cold-rolling process).

Figure 4:
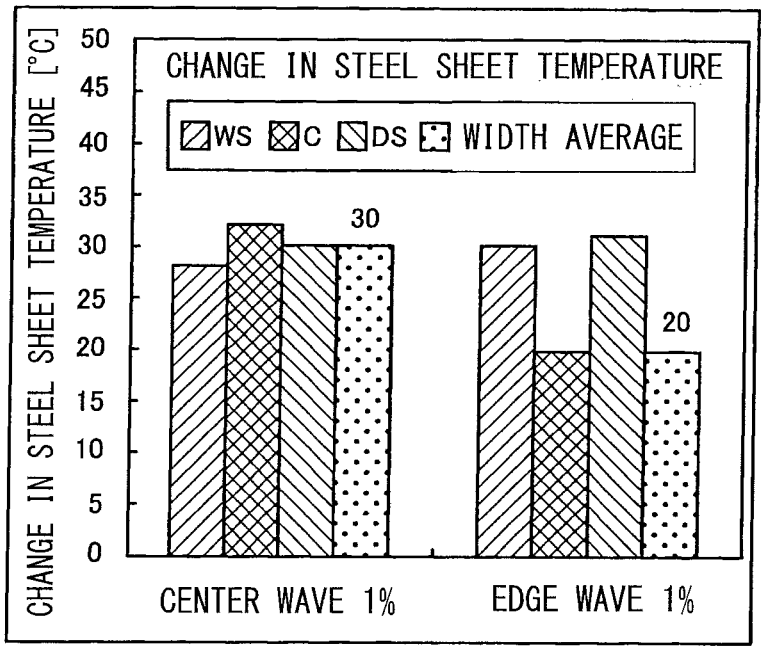
FIG. 4 is a graph illustrating temperature changes at the respective places in the hot-rolled steel sheet H in a case in which a center-wave shape having a steepness of 1% is formed in the hot-rolled steel sheet H and a case in which an edge wave shape having a steepness of 1% is formed.
Figure 5:
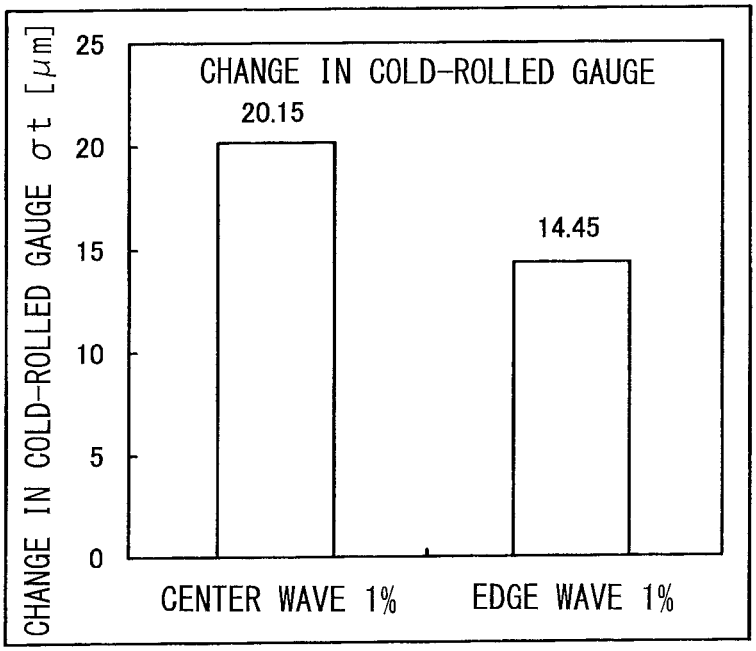
FIG. 5 is a graph illustrating a change in a cold-rolling gauge (change in the sheet thickness) in the cold-rolling process which is a post process in a case in which a center wave shape having a steepness of 1% is formed in the hot-rolled steel sheet H and a case in which an edge wave shape having a steepness of 1% is formed.

FIG. 4 is a graph illustrating temperature changes at the respective places in the hot-rolled steel sheet H in a case in which a center wave shape having a steepness of 1% is formed in the hot-rolled steel sheet H and a case in which an edge wave shape having a steepness of 1% is formed in the hot-rolled steel sheet H. In addition, FIG. 5 is a graph illustrating a change in a cold-rolling gauge (change in the sheet thickness) in the cold-rolling process in each of a case in which a center wave shape having a steepness of 1% is formed in the hot-rolled steel sheet H and a case in which an edge wave shape having a steepness of 1% is formed in the hot-rolled steel sheet H. Meanwhile, work side (WS) and drive side (DS) refer to an edge portion of the hot-rolled steel sheet H on one side in the width direction (WS) and an edge portion of the hot-rolled steel sheet H on the other side in the width direction (DS).

As illustrated in FIGS. 4 and 5, it was found that, in a case in which the wave shape of the hot-rolled steel sheet H during cooling in the hot rolling facility 1 is set to an edge wave shape, changes in the temperature of a sheet width center (C) and a width-average temperature are suppressed, and a change in the sheet thickness in the cold-rolling process is suppressed, compared with a case in which the wave shape is set to the center wave shape (as illustrated in FIG. 5, approximately 30% of an effect of suppressing the sheet thickness change can be obtained with the edge wave shape compared with the center wave shape).

This is because, the center wave shape has a symmetric shape at a steel sheet center portion and has a uniform displacement in the width direction, and therefore an ununiform cooling deviation is easily caused in the sheet-threading direction (rolling direction), but the edge wave shape has an antisymmetric shape in which an influence at one edge wave (for example, the wave shape at WS) has an influence in the other edge wave (for example, the wave shape at DS).

That is, in a case in which the wave shape of the hot-rolled steel sheet H is an edge wave shape, since the phase of the wave shape at DS of the hot-rolled steel sheet H is deviated 180 degrees from that of the wave shape at WS, cooling deviations corresponding to wave shapes having deviated phases are respectively caused, and, when the temperature average in the sheet width direction is taken, the temperature standard deviation in the sheet-threading direction becomes small.

Therefore, in a case in which the wave shape of the hot-rolled steel sheet H is an edge wave shape, in the hot rolling facility 1, substantially uniform cooling is carried out in the cold-rolling process so that the change in the sheet thickness is not influenced, and it is possible to improve the yield of the finally-obtained steel sheet product.

Figure 12:
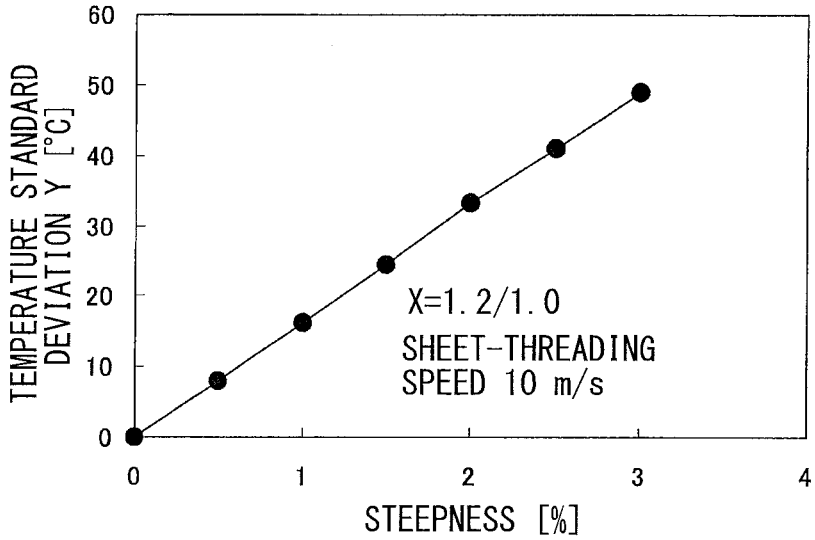
FIG. 12 is a graph illustrating the correlation between the steepness and the temperature standard deviation Y of the hot-rolled steel sheet H which have been obtained under conditions in which the top and bottom heat transfer coefficient ratio X and the sheet-threading speed are set to constant values.

Furthermore, as a result of investigating a correlation between the steepness of the edge wave shape formed in the hot-rolled steel sheet H and the temperature standard deviation Y of the cooled hot-rolled steel sheet H in the rolling direction, the inventors obtained results from an investigation in which the steepness and the temperature standard deviation Y have a substantially proportional relation as illustrated in FIG. 12. Meanwhile, FIG. 12 is a graph illustrating the correlation between the steepness and the temperature standard deviation Y which have been obtained under conditions in which the sheet-threading speed and the top and bottom heat transfer coefficient ratio X described below are set to constant values.

The investigation results illustrated in FIGS. 4, 5 and 12 indicate that, when the wave shape of the hot-rolled steel sheet H is controlled to be an edge wave shape, it is possible to control the temperature standard deviation Y of the cooled hot-rolled steel sheet H to an arbitrary value in accordance with the steepness of the edge wave shape.

That is, when a steepness at which a temperature standard deviation Y required during actual operation (temperature standard deviation Y at which a change in the sheet thickness in the cold-rolling process is suppressed to a permissible level) can be realized is obtained based on the correlation between the steepness and the temperature standard deviation Y illustrated in FIG. 12, the steepness is set as a target steepness, and the operation parameters of the finishing mill 13 are controlled so as to match the steepness of the edge wave shape formed in the hot-rolled steel sheet H with the above target steepness, thereby it is possible to improve the yield of a finally-obtained steel sheet product, which is the object of the present invention.

Hereinafter, the method for manufacturing a steel sheet of the present embodiment will be described based on the above findings. The method for manufacturing a steel sheet of the present embodiment includes a hot-rolling process in which a steel material (rough bar Br) is hot-rolled using the finishing mill 13 so as to obtain the hot-rolled steel sheet H having an edge wave shape with a wave height periodically changing in the rolling direction, and a cooling process in which the hot-rolled steel sheet obtained from the hot-rolling process is cooled in a cooling section (that is, the cooling apparatus 14) provided on a sheet-threading path.

Here, the hot-rolling process includes a target steepness-setting process in which a target steepness of the edge wave shape is set based on the first correlation data indicating the correlation (refer to FIG. 12) between the steepness of the hot-rolled steel sheet H and the temperature standard deviation Y of the hot-rolled steel sheet H after cooling (or during cooling), which have been experimentally obtained in advance, and a shape-controlling process in which operation parameters of the finishing mill 13 are controlled so as to match the steepness of the edge wave shape with the target steepness.

In the target steepness-setting process, a steepness at which a temperature standard deviation Y required during actual operation (temperature standard deviation Y at which a change in the sheet thickness in the cold-rolling process is suppressed to a permissible level) can be realized is obtained based on the first correlation data, and the steepness is set as the target steepness. For example, when FIG. 12 is referenced, in a case in which the temperature standard deviation Y required during actual operation is 10° C., the target steepness is set to 0.5%.

In the shape-controlling process, operation parameters of the finishing mill 13 are controlled so as to match the steepness of the edge wave shape formed in the hot-rolled steel sheet H with the target steepness (for example, 0.5%). The operation parameters of the finishing mill 13 include sheet-threading speed, heating temperature, suppress strength and the like. Therefore, it is possible to match the steepness of the edge wave shape formed in the hot-rolled steel sheet H with the target steepness by adjusting values of the operation parameters.

Specifically, when a distance meter that measures a distance from the surface (top surface) of the hot-rolled steel sheet H is installed on the exit side of the finishing mill 13, it is possible to compute the steepness of the edge wave shape of the hot-rolled steel sheet H based on distance measurement results obtained from the distance meter in real time. In addition, the operation parameters of the finishing mill 13 may be feedback-controlled so as to match the computation results of the steepness with the target steepness. It is possible to use a controller having an ordinary microcomputer and the like for the computation and feedback-control of steepness.

Meanwhile, it was found from the investigation results illustrated in FIGS. 4 and 5 that, in the target steepness-setting process, the target steepness is preferably set in a range of more than 0% to 1%. Thereby, the temperature standard deviation Y of the cooled hot-rolled steel sheet H is suppressed at approximately 18° C. or lower (refer to FIG. 12), and it is possible to significantly suppress the change in the sheet thickness of the steel sheet product in the cold-rolling process.

Furthermore, in order to suppress the temperature standard deviation Y of the hot-rolled steel sheet H as much as possible, in the target steepness-setting process, the target steepness is more preferably set in a range of more than 0% to 0.5%. According to what described above, it is possible to suppress the temperature standard deviation Y of the hot-rolled steel sheet H at approximately 10° C. or lower (refer to FIG. 12).

As described above, according to the method for manufacturing a steel sheet of the present embodiment, it becomes possible to improve the yield of a steel sheet manufactured through at least the hot-rolling process and the cooling process.

Furthermore, in order to further reduce the temperature standard deviation Y of the cooled hot-rolled steel sheet H, the cooling process of the embodiment described above preferably includes two processes of a target ratio-setting process and a cooling control process.

The details will be described below, and, in the target ratio-setting process, a top and bottom heat transfer coefficient ratio X1, at which a temperature standard deviation Y becomes a minimum value Ymin, is set as a target ratio Xt based on second correlation data indicating a correlation between a top and bottom heat transfer coefficient ratio X, which is a ratio of heat transfer coefficients of the top and bottom surfaces of the hot-rolled steel sheet H, and the temperature standard deviation Y of the hot-rolled steel sheet H during or after cooling, which have been experimentally obtained in advance under conditions in which the steepness and the sheet-threading speed of the hot-rolled steel sheet H are set to constant values.

In addition, in the cooling control process, at least one of an amount of heat dissipated from the top surface by cooling and an amount of heat dissipated from the bottom surface by cooling of the hot-rolled steel sheet H in the cooling section is controlled so that the top and bottom heat transfer coefficient ratio X of the hot-rolled steel sheet H in the cooling section (a section in which the hot-rolled steel sheet H is cooled using the cooling apparatus 14) matches the target ratio Xt.

The second correlation data used in the target ratio-setting process is experimentally obtained in advance using the hot rolling facility 1 before actual operation (before the hot-rolled steel sheet H is actually manufactured). Hereinafter, a method for obtaining the second correlation data used in the target ratio-setting process will be described in detail.

First, before cooling the hot-rolled steel sheet H in the cooling apparatus 14, the cooling capability (top side cooling capability) of the top side cooling apparatus 14*a* and the cooling capability (bottom side cooling capability) of the bottom side cooling apparatus 14*b* of the cooling apparatus 14 are adjusted respectively in advance. The top side cooling capability and the bottom side cooling capability are adjusted using the heat transfer coefficient of the top surface of the hot-rolled steel sheet H, which is cooled using the top side cooling apparatus 14*a*, and the heat transfer coefficient of the bottom surface of the hot-rolled steel sheet H, which is cooled using the bottom side cooling apparatus 14*b*.

Here, a method for computing the heat transfer coefficients of the top surface and bottom surface of the hot-rolled steel sheet H will be described. The heat transfer coefficient refers to a value obtained by dividing the amount of heat dissipated from unit area by cooling (heat energy) per unit time by the temperature difference between an article to which heat is transferred and a heat medium (heat transfer coefficient=amount of heat dissipated by cooling/temperature difference). The temperature difference herein refers to the difference between the temperature of the hot-rolled steel sheet H, which is measured using a thermometer on an entry side of the cooling apparatus 14, and the temperature of cooling water used in the cooling apparatus 14.

In addition, the amount of heat dissipated by cooling refers to a value obtained by respectively multiplying the temperature difference, specific heat and mass of the hot-rolled steel sheet H (amount of heat dissipated by cooling=temperature difference×specific heat×mass). That is, the amount of heat dissipated by cooling is an amount of heat dissipated by cooling of the hot-rolled steel sheet H in the cooling apparatus 14, and a value obtained by multiplying the difference between the temperatures of the hot-rolled steel sheet H respectively measured using the entry-side thermometer and an exit-side thermometer in the cooling apparatus 14, the specific heat of the hot-rolled steel sheet H and the mass of the hot-rolled steel sheet H cooled using the cooling apparatus 14 respectively.

As described above, the computed heat transfer coefficient of the hot-rolled steel sheet H is classified into the heat transfer coefficient of the top surface and the heat transfer coefficient of the bottom surface of the hot-rolled steel sheet H. The heat transfer coefficients of the top surface and the bottom surface are computed using a ratio that is obtained in advance, for example, in the following manner.

That is, the heat transfer coefficient of the hot-rolled steel sheet H in a case in which the hot-rolled steel sheet H is cooled only using the top side cooling apparatus 14*a* and the heat transfer coefficient of the hot-rolled steel sheet H in a case in which the hot-rolled steel sheet H is cooled only using the bottom side cooling apparatus 14*b* are measured.

At this time, the amount of cooling water from the top side cooling apparatus 14*a* and the amount of cooling water from the bottom side cooling apparatus 14*b* are set to be equal. The inverse number of the ratio between the measured heat transfer coefficient in a case in which the top side cooling apparatus 14*a* is used and the heat transfer coefficient in a case in which the bottom side cooling apparatus 14*b* is used becomes a top and bottom ratio of the amount of cooling water of the top side cooling apparatus 14*a* and the amount of cooling water of the bottom side cooling apparatus 14*b* in a case in which a top and bottom heat transfer coefficient ratio X, which will be described below, is set to "1".

In addition, the above-mentioned ratio of the heat transfer coefficients of the top surface and the bottom surface of the hot-rolled steel sheet H (top and bottom heat transfer coefficient ratio X) is computed by multiplying the amount of cooling water of the top side cooling apparatus 14*a* or the amount of cooling water of the bottom side cooling apparatus 14*b* when cooling the hot-rolled steel sheet H by the top and bottom ratio of the amounts of cooling water obtained in the above manner.

In addition, in the above description, the heat transfer coefficients of the hot-rolled steel sheet H cooled only using the top side cooling apparatus 14*a* and only using the bottom side cooling apparatus 14*b* are used, but the heat transfer coefficient of the hot-rolled steel sheet H cooled using both the top side cooling apparatus 14*a* and the bottom side cooling apparatus 14*b* may be used. That is, the heat transfer coefficients of the hot-rolled steel sheet H in a case in which the amounts of cooling water of the top side cooling apparatus 14*a* and the bottom side cooling apparatus 14*b* are changed are measured, and the ratio of the heat transfer coefficients of the top surface and the bottom surface of the hot-rolled steel sheet H may be computed using the ratio of the heat transfer coefficients.

As described above, the heat transfer coefficients of the hot-rolled steel sheet H are computed, and the heat transfer coefficients of the top surface and the bottom surface of the hot-rolled steel sheet H are computed based on the above ratio of the heat transfer coefficients of the top surface and the bottom surface of the hot-rolled steel sheet H (top and bottom heat transfer coefficient ratio X).

Figure 6:
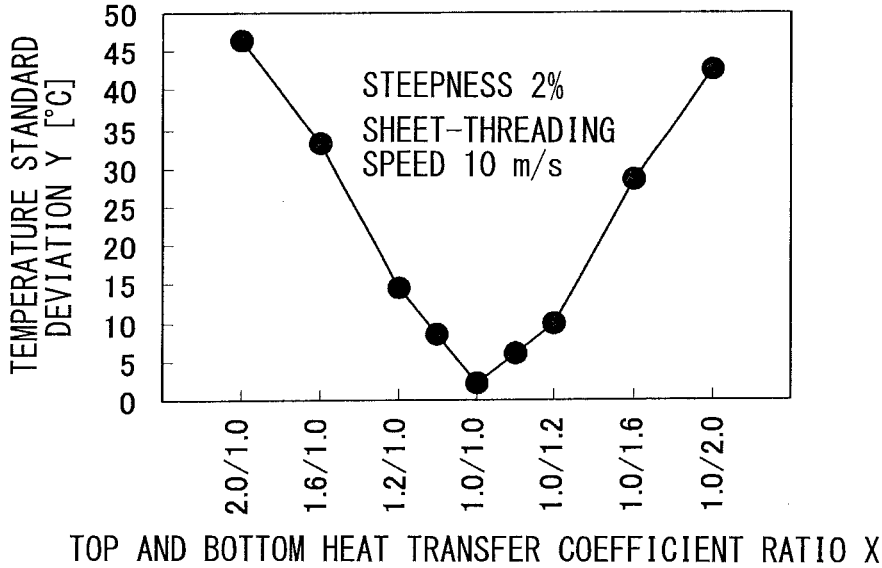
FIG. 6 is a graph illustrating a correlation between a top and bottom heat transfer coefficient ratio X and a temperature standard deviation Y which have been obtained under a condition in which the steepness and sheet-threading speed of the hot-rolled steel sheet H are set to constant values.

In addition, the cooling capabilities of the top side cooling apparatus 14*a* and the bottom side cooling apparatus 14*b* are adjusted respectively using the top and bottom heat transfer coefficient ratio X of the hot-rolled steel sheet H based on FIG. 6. The horizontal axis of FIG. 6 indicates a ratio of an average heat transfer coefficient of the top surface to an average heat transfer coefficient of the bottom surface of the hot-rolled steel sheet H (that is, equivalent to the top and bottom heat transfer coefficient ratio X), and the vertical axis indicates a standard deviation of temperature between the maximum temperature and the minimum temperature of the hot-rolled steel sheet H in the rolling direction (temperature standard deviation Y).

In addition, FIG. 6 shows data (second correlation data) indicating the correlation between the top and bottom heat transfer coefficient ratio X and the temperature standard deviation Y which are obtained by actually measuring the temperature standard deviation Y of the cooled hot-rolled steel sheet H while changing the top and bottom heat transfer coefficient ratio X of the hot-rolled steel sheet H by adjusting the cooling capabilities of the top side cooling apparatus 14*a* and the bottom side cooling apparatus 14*b* under conditions in which the steepness of the wave shape of the hot-rolled steel sheet H and the sheet-threading speed of the hot-rolled steel sheet H are set to constant values.

With reference to FIG. 6, it was found that the correlation between the temperature standard deviation Y and the top and bottom heat transfer coefficient ratio X becomes a V-shaped relationship in which the temperature standard deviation Y becomes the minimum value Ymin when the top and bottom heat transfer coefficient ratio X is "1".

Meanwhile, the steepness of the wave shape of the hot-rolled steel sheet H refers to a value obtained by dividing the amplitude of the wave shape by the length of a cycle in the rolling direction. FIG. 6 illustrates a correlation between the top and bottom heat transfer coefficient ratio X and the temperature standard deviation Y which are obtained under conditions in which the steepness of the hot-rolled steel sheet H is set to 2% and the sheet-threading speed is set to 600 m/min (10 m/sec). The temperature standard deviation Y may be measured during the cooling of the hot-rolled steel sheet H, or may be measured after the cooling. In addition, in FIG. 6, the target cooling temperature of the hot-rolled steel sheet H is a temperature of 600° C. or higher, for example, 800° C.

In the target ratio-setting process, the top and bottom heat transfer coefficient ratio X1, at which the temperature standard deviation Y becomes the minimum value Ymin, is set as the target ratio Xt based on the second correlation data experimentally obtained in advance as described above. The second correlation data may be prepared in a form of data (table data) that indicate the correlation between the top and bottom heat transfer coefficient ratio X and the temperature standard deviation Y using a table (table form), or may be prepared in a form of data that indicate the correlation between the top and bottom heat transfer coefficient ratio X and the temperature standard deviation Y using a mathematical formula (for example, regression formula).

For example, in a case in which the second correlation data is prepared in a form of data indicating the correlation between the top and bottom heat transfer coefficient ratio X and the temperature standard deviation Y using a regression formula, since the V-shaped line illustrated in FIG. 6 is drawn to be almost linear on both sides of the bottom portion, the regression formula may be derived by linearly regressing the line. When the data is considered to be a linear distribution, the number of times of confirmation using test materials or the number of times of correction for estimating calculation can be small.

Therefore, the minimum value Ymin of the temperature standard deviation Y is searched using a variety of methods, for example, a binary method, a golden section method and random search which are generally known search algorithms. The top and bottom heat transfer coefficient ratio X1 at which the temperature standard deviation Y of the hot-rolled steel sheet H becomes the minimum value Ymin is derived in the above manner based on the second correlation data illustrated in FIG. 6. In addition, here, the regression formulae of the temperature standard deviations Y of the hot-rolled steel sheet H in the rolling direction with respect to the top and bottom heat transfer coefficient ratio X may be obtained respectively on both sides of an equal point above and below the average heat transfer coefficient.

Here, a method for searching the minimum value Ymin of the temperature standard deviation Y of the hot-rolled steel sheet H using the above-described binary method will be described.

Figure 7:
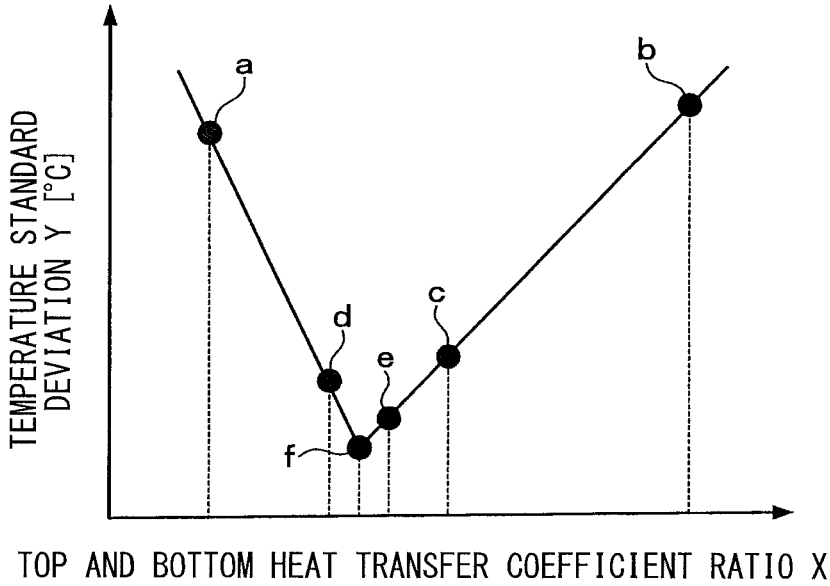
FIG. 7 is an explanatory view illustrating a method for searching a minimum point (minimum value Ymin) of the temperature standard deviation Y from the correlation illustrated in FIG. 6.

FIG. 7 illustrates a standard case in which mutually different regression lines are obtained on both sides of the minimum value Ymin of the temperature standard deviation Y. As illustrated in FIG. 7, first, temperature standard deviations Ya, Yb and Yc actually measured at a point, b point and c point which is in the center between the a point and the b point are extracted respectively. Meanwhile, the center between the a point and the b point indicates the c point at which a value between the top and bottom heat transfer coefficient ratio Xa at the a point and the top and bottom heat transfer coefficient ratio Xb at the b point is present, and this shall apply below. In addition, to which of Ya and Yb is the temperature standard deviation Yc closer is determined. In the embodiment, Yc is closer to Ya.

Next, a temperature standard deviation Yd at a d point between the a point and the c point is extracted. In addition, to which of Ya and Ye is the temperature standard deviation Yd closer is determined. In the embodiment, Yd is closer to Ye.

Next, a temperature standard deviation Ye at an e point between the c point and the d point is extracted. In addition, to which of Yc and Yd is the temperature standard deviation Ye closer is determined. In the embodiment, Ye is closer to Yd.

The above computation is repeated, and a minimum point f (minimum value Ymin) of the temperature standard deviation Y of the hot-rolled steel sheet H is specified. Meanwhile, in order to specify the practical minimum point f, the above computation needs to be carried out, for example, five times. In addition, the minimum point f may be specified by dividing the range of the top and bottom heat transfer coefficient ratio X of a search target into 10 sections, and carrying out the above computation in each of the sections.

In addition, the top and bottom heat transfer coefficient ratio X may be corrected using the so-called Newton's method. In this case, a partial difference between the top and bottom heat transfer coefficient ratio X with respect to the actual value of the temperature standard deviation Y and the top and bottom heat transfer coefficient ratio X at which the temperature standard deviation Y becomes zero is obtained using the above-described regression formula, and the top and bottom heat transfer coefficient ratio X when cooling the hot-rolled steel sheet H may be amended using the partial difference.

The top and bottom heat transfer coefficient ratio X1 at which the temperature standard deviation Y of the hot-rolled steel sheet H becomes the minimum value Ymin (Xf in FIG. 7) is derived as described above. In addition, for the relationship between the temperature standard deviation Y and the top and bottom heat transfer coefficient ratio X, which forms a V shape, it is easy to divide the graph into two sides, and obtain regression functions respectively using the method of least squares.

Furthermore, even in any cases in which the wave shape formed in the hot-rolled steel sheet H is an edge wave shape or a center wave shape, it is possible to derive the top and bottom heat transfer coefficient ratio X1, at which the temperature standard deviation Y of the hot-rolled steel sheet H becomes the minimum value Ymin using a fact that the relationship between the temperature standard deviation Y and the top and bottom heat transfer coefficient ratio X becomes V-shaped as described above.

Meanwhile, the hot-rolled steel sheet H is uniformly cooled in the sheet width direction using water as ordinarily cooled. In addition, since the temperature standard deviation in the sheet width direction is caused by the alternate occurrence of the temperature standard deviation Y in the rolling direction on the right and left sides, the temperature standard deviation in the sheet width direction is also further reduced when the temperature standard deviation Y in the rolling direction is reduced.

In addition, when FIG. 6 is referenced, the top and bottom heat transfer coefficient ratio X1 at which the temperature standard deviation Y of the hot-rolled steel sheet H becomes the minimum value Ymin is "1". Therefore, in a case in which the second correlation data as illustrated in FIG. 6 is obtained, the target ratio Xt is set to "1" in the target ratio-setting process during an actual operation in order to minimize the temperature standard deviation Y, that is, in order to uniformly cool the hot-rolled steel sheet H.

In addition, in the cooling control process, at least one of the amount of heat dissipated from the top surface by cooling and the amount of heat dissipated from the bottom surface by cooling of the hot-rolled steel sheet H in the cooling section is controlled so that the top and bottom heat transfer coefficient ratio X of the hot-rolled steel sheet H in the cooling section matches the target ratio Xt (that is "1").

Specifically, in order to match the top and bottom heat transfer coefficient ratio X of the hot-rolled steel sheet H in the cooling section to the target ratio Xt (that is "1"), the amount of heat dissipated from the top surface by cooling and the amount of heat dissipated from the bottom surface by cooling of the hot-rolled steel sheet H may be equaled by, for example, adjusting the cooling capability of the top side cooling apparatus 14*a* and the cooling capability of the bottom side cooling apparatus 14*b* to be equal.

Table 1 describes the second correlation data illustrated in FIG. 6 (that is, the correlation between the top and bottom heat transfer coefficient ratio X and the temperature standard deviation Y), values obtained by subtracting the respective temperature standard deviations Y by the minimum value Ymin (=2.3° C.) (the differences of the standard deviations from the minimum value), and the evaluation of the respective temperature standard deviations Y.

In the top and bottom heat transfer coefficient ratio X in Table 1, the numerator is the heat transfer coefficient of the hot-rolled steel sheet H on the top surface, and the denominator is the heat transfer coefficient of the hot-rolled steel sheet H on the bottom surface. In addition, in the evaluation in Table 1 (the evaluation of the conditions of the top and bottom heat transfer coefficient ratio X), the condition under which the temperature standard deviation Y becomes the minimum value Ymin is considered as "A", the condition under which the difference of the standard deviation from the minimum value becomes 10° C. or less, that is, the operation becomes preferable as described below is considered as "B", and the condition under which the computation is heuristically carried out in order to obtain the above-described regression formula is considered as"C". In addition, when Table 1 is referenced, the top and bottom heat transfer coefficient ratio X1 at which the evaluation becomes "A", that is, the temperature standard deviation Y of the hot-rolled steel sheet H becomes the minimum value Ymin is "1".

TABLE 1

| Top and bottom heat transfer coefficient ratio X | Temperature standard deviation Y (° C.) | Difference of standard deviation from minimum value (° C.) | Evaluation |
|---|---|---|---|
| 1.6/1.0 | 33.2 | 30.9 | C |
| 1.2/1.0 | 14.6 | 12.3 | C |
| 1.1/1.0 | 8.5 | 6.2 | B |
| 1.0/1.0 | 2.3 | 0.0 | A |
| 1.0/1.1 | 6.1 | 3.8 | B |
| 1.0/1.2 | 9.8 | 7.5 | B |
| 1.0/1.6 | 28.7 | 26.4 | C |

Meanwhile, when the temperature standard deviation Y of the hot-rolled steel sheet H at least converges in a range of the minimum value Ymin to the minimum value Ymin+10° C., it can be said that the variations in yield stress, tensile strength and the like are suppressed within the manufacturing permissible ranges, and the hot-rolled steel sheet H can be uniformly cooled. That is, in the target ratio-setting process, the top and bottom heat transfer ratio X at which the temperature standard deviation Y converges in a range of the minimum value Y to the minimum value Ymin+10° C. may be set as the target ratio Xt based on the second correlation data experimentally obtained in advance.

Meanwhile, since there is a variety of noise in the temperature measurement of the hot-rolled steel sheet H, there are cases in which the minimum value Ymin of the temperature standard deviation Y of the hot-rolled steel sheet H is not strictly zero. Therefore, the manufacturing permissible range is set to a range in which the temperature standard deviation Y of the hot-rolled steel sheet H is the minimum value Ymin to the minimum value Ymin+10° C. in order to remove the influence of the noise.

In order to converge the temperature standard deviation Y in a range of the minimum value Ymin to the minimum value Ymin+10° C., in FIG. 6 or 7, it is necessary to pull the straight line in the horizontal axis direction from a point in the vertical axis at which the temperature standard deviation Y becomes the minimum value Ymin+10° C., obtain two intersections between the straight line and two regression lines on both sides of the V-shaped curve, and set the target ratio Xt from the top and bottom heat transfer coefficient ratio X between the two intersections. Meanwhile, in Table 1, the temperature standard deviation Y can be converged in a range of the minimum value Ymin to the minimum value Ymin+10° C. by setting the top and bottom heat transfer coefficient ratio X with an evaluation of "B" as the target ratio Xt.

In addition, in order to match the top and bottom heat transfer coefficient ratio X to the target ratio Xt, it is easiest to operate the sprayed cooling water density of at least one of the top side cooling apparatus 14*a* and the bottom side cooling apparatus 14*b*. Therefore, for example, in FIGS. 6 and 7, the values in the horizontal axis are replaced by the top and bottom sprayed water density ratio, and the regression formula of the temperature standard deviation Y of the hot-rolled steel sheet H with respect to the top and bottom ratio of the sprayed water density may be obtained on both sides of an equal point above and below the average heat transfer coefficient. Here, the equal point above and below the average heat transfer coefficient does not necessarily become an equal point above and below the sprayed cooling water density, and therefore the regression formula may be obtained by carrying out tests slightly widely.

In addition, during an actual operation, there is a possibility that the value of at least one of the steepness and the sheet-threading speed may change due to a change in the manufacturing conditions. When at least one of the steepness and the sheet-threading speed is changed, the correlation between the top and bottom heat transfer coefficient ratio X and the temperature standard deviation Y changes. Therefore, the second correlation data is prepared for each of a plurality of conditions having different values of the steepness and the sheet-threading speed, and, in the target ratio-setting process, the target ratio Xt may be set based on a second correlation data in accordance with actual measured values of the steepness and the sheet-threading speed during the actual operation of the plurality of second correlation data. Thereby, it becomes possible to carry out uniform cooling suitable for the manufacturing conditions during the actual operation.

Here, as a result of thorough studies regarding the adjustment of the cooling capabilities of the top side cooling apparatus 14*a* and the bottom side cooling apparatus 14*b* (control of the amount of heat dissipated from the top surface by cooling and the amount of heat dissipated from the bottom surface by cooling of the hot-rolled steel sheet H) in order to uniformly cool the hot-rolled steel sheet H, the inventors further obtained the following findings.

As a result of repeating thorough studies regarding the characteristics of the temperature standard deviation Y generated by cooling in a state in which a wave shape of the hot-rolled steel sheet H is generated, the inventors clarified the following fact.

Generally, during an actual operation, it is necessary to maintain the quality of the hot-rolled steel sheet H by controlling the temperature of the hot-rolled steel sheet H at a predetermined target temperature (a temperature suitable for coiling) when coiling the hot-rolled steel sheet H using the coiling apparatus 15.

Therefore, a temperature-measuring process in which the temperature of the hot-rolled steel sheet H on the downstream side of the cooling section (that is, the cooling apparatus 14) is measured in chronological order, an average temperature value-computing process in which a chronological average value of the temperature is computed based on the measurement result of the temperature, and an amount of heat dissipated by cooling-adjusting process in which the total value of the amount of heat dissipated from the top surface by cooling and the amount of heat dissipated from the bottom surface by cooling of the hot-rolled steel sheet H in the cooling section is adjusted so that the chronological average value of the temperature matches a predetermined target temperature may be newly added to the above-described target ratio-setting process and cooling control process.

Figure 16:
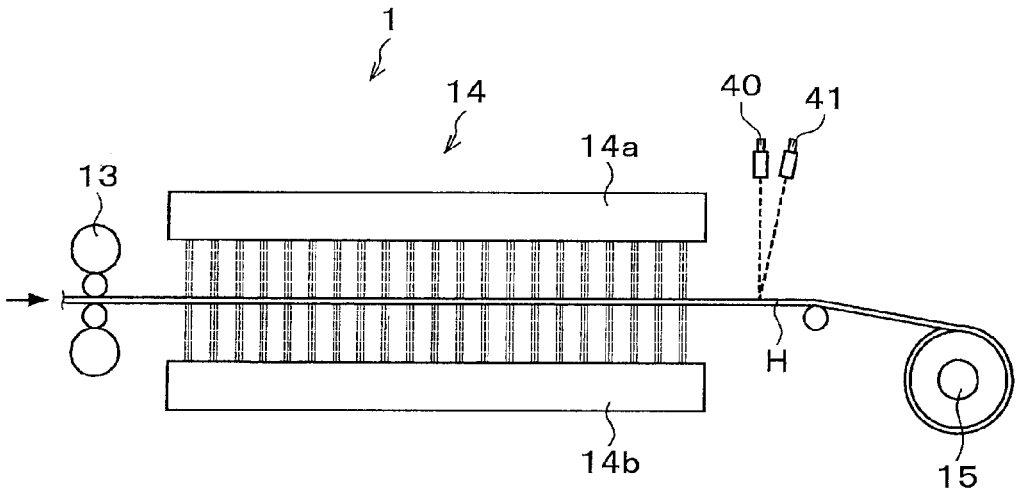
FIG. 16 is an explanatory view illustrating the details of a periphery of the cooling apparatus 14 in the hot rolling facility 1.

In order to realize the new processes, a thermometer 40 which is disposed between the cooling apparatus 14 and the coiling apparatus 15 as illustrated in FIG. 16 and measures the temperature of the hot-rolled steel sheet H can be used.

In the temperature-measuring process, with respect to the hot-rolled steel sheet H transported from the cooling apparatus 14 to the coiling apparatus 15, the temperatures at locations set in the rolling direction of the hot-rolled steel sheet H are measured at certain time intervals (sampling intervals) using the thermometer 40, and chronological data of the temperature measurement results are obtained. Meanwhile, the temperature measurement area using the thermometer 40 includes all the area of the hot-rolled steel sheet H in the width direction. In addition, when the sheet-threading speed (transportation speed) of the hot-rolled steel sheet H is multiplied at the sampling times of the respective temperature measurement results, the locations of the hot-rolled steel sheet H in the rolling direction, at which the respective temperature measurement results have been obtained, can be computed. That is, when the sampling times of the temperature measurement results are multiplied by the sheet-threading speed, it becomes possible to link the chronological data of the temperature measurement results to the locations in the rolling direction.

In the average temperature value-computing process, a chronological average value of the temperature measurement results is computed using the chronological data of the temperature measurement results. Specifically, each time when a certain number of the temperature measurement results are obtained, the average value of the certain number of the temperature measurement results may be computed. In addition, in the amount of heat dissipated by cooling-adjusting process, the total value of the amount of heat dissipated from the top surface by cooling and the amount of heat dissipated from the bottom surface by cooling of the hot-rolled steel sheet H in the cooling section is adjusted so that the chronological average value of the temperature measurement results computed as described above matches a predetermined target temperature.

Here, it is necessary to adjust the total value of the amount of heat dissipated from the top surface by cooling and the amount of heat dissipated from the bottom surface by cooling while achieving a control target that matches the top and bottom heat transfer coefficient ratio X of the hot-rolled steel sheet H in the cooling section to the target ratio Xt.

Specifically, when adjusting the total value of the amount of heat dissipated from the top surface by cooling and the amount of heat dissipated from the bottom surface by cooling, the on-off control of cooling headers connected to the cooling apparatus 14 may be carried out on a theoretical value obtained in advance using an experiment theoretical formula represented by, for example, Mitsuzuka's formula based on a learned value set to correct the error with an actual operation achievement. Alternatively, the on-off of the cooling headers may be feedback-controlled or feedforward-controlled based on the temperature actually measured using the thermometer 40.

Next, the cooling control of ROT of the related art will be described using data obtained from the above-described thermometer 40 and a shape meter 41 that measures the wave shape of the hot-rolled steel sheet H which is disposed between the cooling apparatus 14 and the coiling apparatus 15 as illustrated in FIG. 16.

Meanwhile, the shape meter 41 measures the shape of the same measurement location (hereinafter this measurement location will be sometimes referred to as a fixed point) as the thermometer 40 set on the hot-rolled steel sheet H. Here, the shape refers to the steepness obtained through the line integration of the heights or changing components of pitches of the wave using the movement amount of the hot-rolled steel sheet H in the sheet-threading direction as the changing amount of the hot-rolled steel sheet H in the height direction observed in a measurement at a fixed point. In addition, at the same time, the changing amount per unit time, that is, the changing speed is also obtained. Furthermore, similarly to the temperature measurement area, the shape measurement area includes all the areas of the hot-rolled steel sheet H in the width direction. Similarly to the temperature measurement results, when the sampling times of the respective measurement results (steepness, changing speed and the like) are multiplied by the sheet-threading speed, it becomes possible to link the chronological data of the respective measurement results to the locations in the rolling direction.

Figure 8:
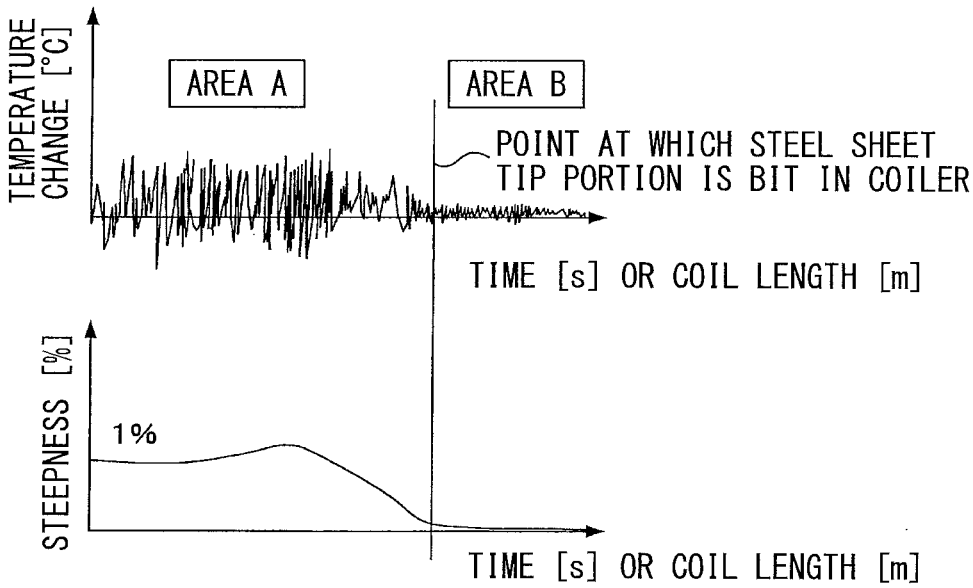
FIG. 8 is a graph illustrating a relationship between temperature change and steepness of the hot-rolled steel sheet H during cooling in ROT of a typical strip in an ordinary operation, in which the top graph indicates the temperature change with respect to a distance from a coil tip or a time at which a coil passes a fixed point, and the bottom graph indicates the steepness with respect to the distance from the coil tip or the time at which the coil passes the fixed point.

FIG. 8 illustrates the relationship between the temperature change and steepness of the hot-rolled steel sheet H during cooling in ROT of a typical strip in an ordinary operation. The top and bottom heat transfer coefficient ratio X of the hot-rolled steel sheet H in FIG. 8 is 1.2:1, and the top side cooling capability is superior to the bottom side cooling capability. The top graph in FIG. 8 indicates the temperature change with respect to the distance from a coil tip or a time at which a coil passes the fixed point, and the bottom graph in FIG. 8 indicates the steepness with respect to the distance from the coil tip or the time at which the coil passes the fixed point.

The area A in FIG. 8 is an area before the strip tip portion illustrated in FIG. 16 is bit in a coiler of the coiling apparatus 15 (since there is no tension, the shape is defective in this area). The area B in FIG. 8 is an area after the strip tip portion is bit in the coiler (the area in which the wave shape is changed to be flat by the influence of unit tension). There is a demand for improving a large temperature change (that is, the temperature standard deviation Y) occurring in the area A in which the shape of the hot-rolled steel sheet H is not flat.

Therefore, the inventors carried out thorough tests for the purpose of controlling the increase in the temperature standard deviation Y in ROT, and, consequently, obtained the following findings.

Figure 9:
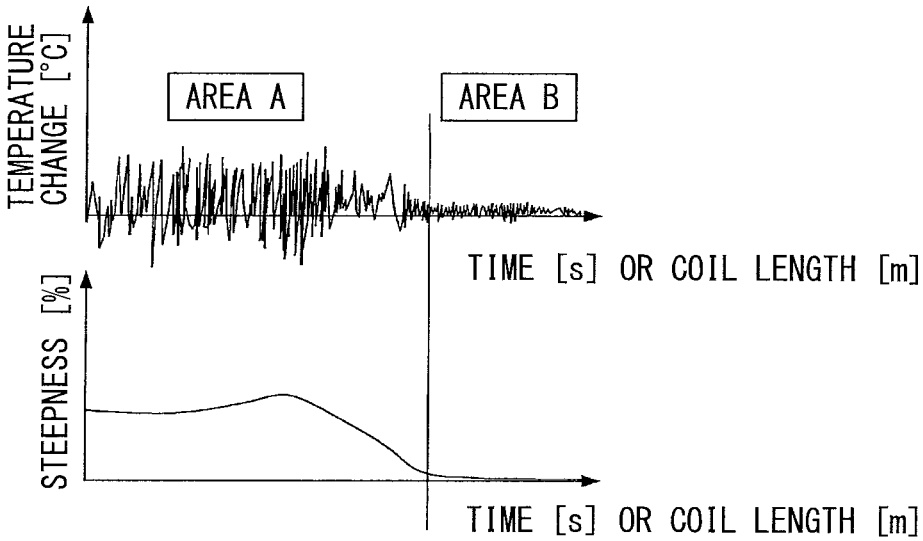
FIG. 9 is a graph illustrating the relationship between the temperature change and steepness of the hot-rolled steel sheet H during cooling in ROT of the typical strip in the ordinary operation.

Similarly to FIG. 8, FIG. 9 illustrates the temperature-changing component with respect to the steepness of the same shape during cooling in ROT of the typical strip in the ordinary operation. The temperature-changing component is a residual error obtained by subtracting the actual steel sheet temperature by the chronological average of the temperature (hereinafter sometimes referred to as "average temperature"). For example, the average temperature may be the average of the temperature of a range that is a cycle or more of the wave shape of the hot-rolled steel sheet H.

Meanwhile, the average temperature is, in principle, the average of the temperature of a range of the unit cycle. In addition, it is confirmed from operation data that there is no large difference between the average temperature of a range of a cycle and the average temperature of a range of two or more cycles.

Therefore, the average temperature simply needs to be computed from a range of at least a cycle of the wave shape. The upper limit of the range of the wave shape of the hot-rolled steel sheet H is not particularly limited; however, a sufficiently accurate average temperature can be obtained when the range is preferably set to 5 cycles. In addition, even when the average temperature is computed not from a range of the unit cycle but from a range of 2 to 5 cycles, a permissible average temperature can be obtained.

Here, when the upward side of the vertical direction (the direction that intersects the top and bottom surfaces of the hot-rolled steel sheet H) of the hot-rolled steel sheet H is set as positive, in an area with a positive changing speed measured at the fixed point, in a case in which the temperature (the temperature measured at the fixed point) of the hot-rolled steel sheet H is lower than the average temperature of a range of one or more cycles of the wave shape of the hot-rolled steel sheet H, at least one of a direction in which the amount of heat dissipated from the top surface by cooling decreases and a direction in which the amount of heat dissipated from the bottom surface by cooling increases is determined as a control direction, and, in a case in which the temperature of the hot-rolled steel sheet H is higher than the average temperature, at least one of a direction in which the amount of heat dissipated from the top surface by cooling increases and a direction in which the amount of heat dissipated from the bottom surface by cooling decreases is determined as the control direction.

In addition, in an area with a negative changing speed measured at the fixed point, in a case in which the temperature of the hot-rolled steel sheet H is lower than the average temperature, at least one of a direction in which the amount of heat dissipated from the top surface by cooling increases and a direction in which the amount of heat dissipated from the bottom surface by cooling decreases is determined as the control direction, and, in a case in which the temperature of the hot-rolled steel sheet H is higher than the average temperature, at least one of a direction in which the amount of heat dissipated from the top surface by cooling decreases and a direction in which the amount of heat dissipated from the bottom surface by cooling increases is determined as the control direction.

Figure 10:
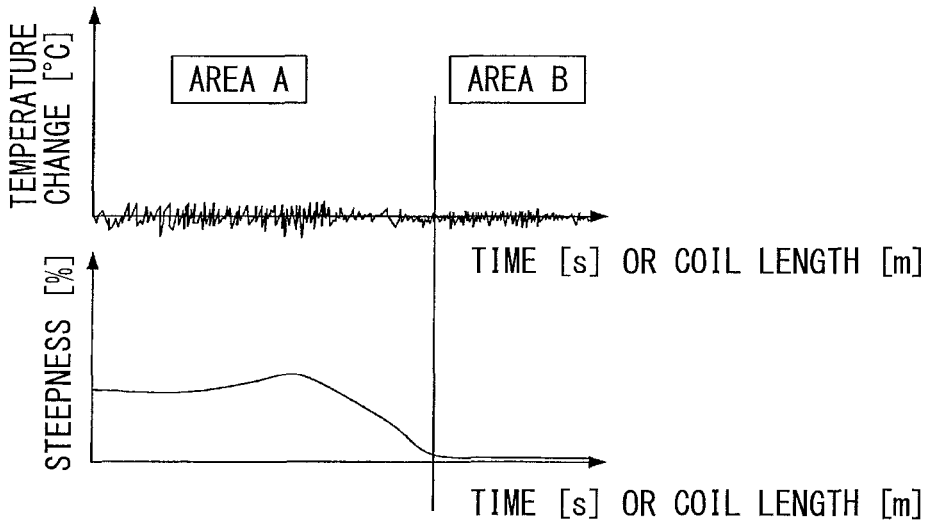
FIG. 10 is a graph illustrating the relationship between the temperature change and steepness of the hot-rolled steel sheet H when an amount of heat dissipated from the top surface by cooling is decreased and an amount of heat dissipated from the bottom surface by cooling is increased in a case in which the temperature of the hot-rolled steel sheet H becomes low with respect to an average temperature of the hot-rolled steel sheet H in an area of a positive changing speed of the hot-rolled steel sheet H and the temperature of the hot-rolled steel sheet H becomes high in an area of a negative changing speed. Meanwhile, the steepness of a wave shape of the hot-rolled steel sheet H refers to a value obtained by dividing an amplitude of the wave shape by a length of a cycle in a rolling direction.

In addition, it was found that, when at least one of the amount of heat dissipated from the top surface by cooling and the amount of heat dissipated from the bottom surface by cooling of the hot-rolled steel sheet H in the cooling section is adjusted based on the control direction determined as described above, as illustrated in FIG. 10, the temperature change occurring in the area A in which the shape of the hot-rolled steel sheet H is not flat can be reduced compared with FIG. 9.

A case in which an opposite operation to the above case is carried out will be described below. In an area with a positive changing speed measured at the fixed point, in a case in which the temperature of the hot-rolled steel sheet H is lower than the average temperature of the hot-rolled steel sheet H, at least one of a direction in which the amount of heat dissipated from the top surface by cooling increases and a direction in which the amount of heat dissipated from the bottom surface by cooling decreases is determined as the control direction, and, in a case in which the temperature of the hot-rolled steel sheet H is higher than the average temperature, at least one of a direction in which the amount of heat dissipated from the top surface by cooling decreases and a direction in which the amount of heat dissipated from the bottom surface by cooling increases is determined as the control direction.

In addition, in an area with a negative changing speed measured at the fixed point, in a case in which the temperature of the hot-rolled steel sheet H is lower than the average temperature, at least one of a direction in which the amount of heat dissipated from the top surface by cooling decreases and a direction in which the amount of heat dissipated from the bottom surface by cooling increases is determined as the control direction, and, in a case in which the temperature of the hot-rolled steel sheet H is higher than the average temperature, at least one of a direction in which the amount of heat dissipated from the top surface by cooling increases and a direction in which the amount of heat dissipated from the bottom surface by cooling decreases is determined as the control direction.

Figure 11:
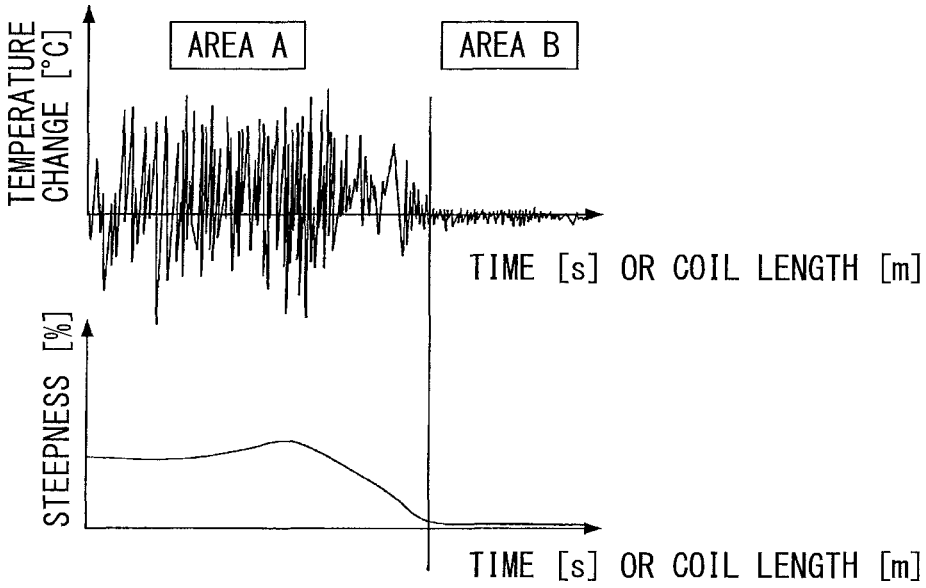
FIG. 11 is a graph illustrating the relationship between the temperature change and steepness of the hot-rolled steel sheet H when the amount of heat dissipated from the top surface by cooling is increased and the amount of heat dissipated from the bottom surface by cooling is decreased in a case in which the temperature of the hot-rolled steel sheet H is low with respect to the average temperature of the hot-rolled steel sheet H in the area of a positive changing speed of the hot-rolled steel sheet H and the temperature of the hot-rolled steel sheet H becomes high in the area of a negative changing speed.

In addition, it was found that, when at least one of the amount of heat dissipated from the top surface by cooling and the amount of heat dissipated from the bottom surface by cooling of the hot-rolled steel sheet H in the cooling section is adjusted based on the control direction determined as described above, as illustrated in FIG. 11, the temperature change occurring in the area A in which the shape of the hot-rolled steel sheet H is not flat enlarges compared with FIG. 9. Meanwhile, in the examples described herein, an assumption does not apply in which the cooling end temperature may be changed. That is, even in a case in which the increase and decrease directions (control direction) of the amount of heat dissipated from the top surface by cooling and the amount of heat dissipated from the bottom surface by cooling are determined as described above, the amount of heat dissipated by cooling is adjusted so that the cooling end temperature of the hot-rolled steel sheet H becomes a predetermined target cooling temperature.

Use of the above relationship clarifies which cooling capability of the top side cooling apparatus 14*a* and the bottom side cooling apparatus 14*b* in the cooling apparatus 14 needs to be adjusted in order to reduce the temperature change, that is, the temperature standard deviation Y. Meanwhile, the above relationship is summarized in Table 2.

TABLE 2

| | | Changing speed | | | |
|---|---|---|---|---|---|
| | | Positive | | Negative | |
| Temperature | | Low | High | Low | High |
| Amount of heat dissipated by cooling | Top surface side | Decrease | Increase | Increase | Decrease |
| | Bottom surface side | Increase | Decrease | Decrease | Increase |

As such, to the target ratio-setting process and the cooling control process described above, the temperature-measuring process in which the temperature (the temperature at the fixed point) of the hot-rolled steel sheet H is measured in chronological order on the downstream side of the cooling section, a changing speed-measuring process in which the changing speed of the hot-rolled steel sheet H in the vertical direction is measured in chronological order at the same place (the fixed point) as the temperature measurement place of the hot-rolled steel sheet H, a control direction-determining process in which the control directions of the amount of heat dissipated from the top surface by cooling and the amount of heat dissipated from the bottom surface by cooling are determined based on the temperature measurement results and the changing speed measurement results, and an amount of heat dissipated by cooling-adjusting process in which at least one of the amount of heat dissipated from the top surface by cooling and the amount of heat dissipated from the bottom surface by cooling of the hot-rolled steel sheet H in the cooling section is adjusted based on the determined control directions may be newly added.

Here, in the control direction-determining process, as described above, in an area with a positive changing speed measured at the fixed point in the hot-rolled steel sheet H, in a case in which the temperature of the hot-rolled steel sheet H at the fixed point is lower than the average temperature of the hot-rolled steel sheet H at the fixed point, at least one of a direction in which the amount of heat dissipated from the top surface by cooling decreases and a direction in which the amount of heat dissipated from the bottom surface by cooling increases is determined as the control direction, and, in a case in which the temperature of the hot-rolled steel sheet H is higher than the average temperature, at least one of a direction in which the amount of heat dissipated from the top surface by cooling increases and a direction in which the amount of heat dissipated from the bottom surface by cooling decreases is determined as the control direction.

In addition, in the control direction-determining process, in an area with a negative changing speed, in a case in which the temperature of the hot-rolled steel sheet H is lower than the average temperature, at least one of a direction in which the amount of heat dissipated from the top surface by cooling increases and a direction in which the amount of heat dissipated from the bottom surface by cooling decreases is determined as the control direction, and, in a case in which the temperature of the hot-rolled steel sheet H is higher than the average temperature, at least one of a direction in which the amount of heat dissipated from the top surface by cooling decreases and a direction in which the amount of heat dissipated from the bottom surface by cooling increases is determined as the control direction.

Meanwhile, in this cooling method as well, it is necessary to adjust the amount of heat dissipated from the top surface by cooling and the amount of heat dissipated from the bottom surface by cooling while achieving a control target that matches the top and bottom heat transfer coefficient ratio X of the hot-rolled steel sheet H in the cooling section to the target ratio Xt.

Meanwhile, when adjusting the cooling capability of the top side cooling apparatus 14*a* and the cooling capability of the bottom side cooling apparatus 14*b*, for example, the cooling headers connected to cooling holes 31 in the top side cooling apparatus 14*a* and the cooling headers connected to cooling holes 31 in the bottom side cooling apparatus 14*b* may be on-off controlled respectively. Alternatively, the cooling capabilities of the respective cooling headers in the top side cooling apparatus 14*a* and the bottom side cooling apparatus 14*b* may be controlled. That is, at least one of the sprayed water density, pressure and water temperature of cooling water sprayed from the respective cooling holes 31 may be adjusted.

In addition, the flow rate or pressure of cooling water sprayed from the top side cooling apparatus 14*a* and the bottom side cooling apparatus 14*b* may be adjusted by thinning out the cooling headers (cooling holes 31) of the top side cooling apparatus 14*a* and the bottom side cooling apparatus 14*b*. For example, in a case in which the cooling capability of the top side cooling apparatus 14*a* before thinning out the cooling headers is superior to the cooling capability of the bottom side cooling apparatus 14*b*, the cooling headers that constitute the top side cooling apparatus 14*a* are preferably thinned out.

The hot-rolled steel sheet H is uniformly cooled by spraying cooling water onto the top surface of the hot-rolled steel sheet H from the top side cooling apparatus 14*a* and spraying cooling water onto the bottom surface of the hot-rolled steel sheet H from the bottom side cooling apparatus 14*b* using the cooling capabilities adjusted as described above.

In the above embodiment, a case in which the second correlation data illustrated in FIG. 6 are obtained with the sheet-threading speed of the hot-rolled steel sheet H fixed to 600 m/min has been described; however, as a result of thorough studies, the inventors found that, when the sheet-threading speed is set to 550 m/min or more in addition to the above control of the amounts of heat dissipated from the top and bottom surfaces, it is possible to more uniformly cool the hot-rolled steel sheet H.

It was found that, if the sheet-threading speed of the hot-rolled steel sheet H is set to 550 m/min or more, the influence of soaked water on the hot-rolled steel sheet H becomes significantly small even when cooling water is sprayed onto the hot-rolled steel sheet H. Therefore, it is possible to prevent the ununiform cooling of the hot-rolled steel sheet H due to soaked water. Meanwhile, the sheet-threading speed of the hot-rolled steel sheet H is preferably faster, but it is impossible to exceed a mechanical limit speed (for example, 1550 m/min). Therefore, substantially, the sheet-threading speed of the hot-rolled steel sheet H in the cooling section becomes set in a range of 550 m/min to the mechanical limit speed. In addition, in a case in which the upper limit value (operational upper limit speed) of the sheet-threading speed during actual operation is specified in advance, the sheet-threading speed of the hot-rolled steel sheet H is preferably set in a range of 550 m/min to the operational upper limit speed (for example, 1200 m/min).

In addition, generally, in the case of the hot-rolled steel sheet H having a large tensile strength (particularly, a steel sheet or the like called a so-called high tensile strength steel having a tensile strength (TS) of 800 MPa or more and a realistic upper limit of 1400 MPa), it is known that heat generation by working occurring in the hot rolling facility 1 during rolling is increased due to a high hardness of the hot-rolled steel sheet H. Therefore, in the related art, the hot-rolled steel sheet H was sufficiently cooled by suppressing the sheet-threading speed of the hot-rolled steel sheet H in the cooling apparatus 14 (that is, the cooling section) to be low.

Therefore, the inventors found that, when cooling is carried out between a pair of finish-rolling rolls 13*a* (that is, rolling stands) provided across, for example, 6 to 7 stands in the finishing mill 13 of the hot rolling facility 1 (so-called inter-stand cooling), the heat dissipation by working is suppressed, and the sheet-threading speed of the hot-rolled steel sheet H in the cooling apparatus 14 can be set to 550 m/min or more. Particularly, in a case in which the tensile strength (TS) of the hot-rolled steel sheet H is 800 MPa or more, heat generation by working of the hot-rolled steel sheet H is suppressed by carrying out the inter-stand cooling, and it becomes possible to maintain the sheet-threading speed of the hot-rolled steel sheet H in the cooling apparatus 14 at 550 m/min or more.

In the above embodiment, the cooling of the hot-rolled steel sheet H using the cooling apparatus 14 is preferably carried out in a range of the exit-side temperature of a finishing mill to a temperature of the hot-rolled steel sheet H of 600° C. A temperature range in which the temperature of the hot-rolled steel sheet H is 600° C. or higher is a so-called film boiling area. That is, in this case, it is possible to prevent a so-called transition boiling area and to cool the hot-rolled steel sheet H in the film boiling area. In the transition boiling area, when cooling water is sprayed onto the surface of the hot-rolled steel sheet H, portions covered with a vapor film and portions in which the cooling water is directly sprayed onto the hot-rolled steel sheet H are present in a mixed state on the surface of the hot-rolled steel sheet H.

Therefore, it is not possible to uniformly cool the hot-rolled steel sheet H. On the other hand, in the film boiling area, since the hot-rolled steel sheet H is cooled in a state in which the entire surface of the hot-rolled steel sheet H is covered with a vapor film, it is possible to uniformly cool the hot-rolled steel sheet H. Therefore, it is possible to more uniformly cool the hot-rolled steel sheet H in a range in which the temperature of the hot-rolled steel sheet H is 600° C. or higher as in the present embodiment.

In the above embodiment, when adjusting the cooling capability of the top side cooling apparatus 14*a* and the cooling capability of the bottom side cooling apparatus 14*b* of the cooling apparatus 14 using the second correlation data illustrated in FIG. 6, the steepness of the wave shape of the hot-rolled steel sheet H and the sheet-threading speed of the hot-rolled steel sheet H were set to be constant. However, there are also cases in which, for example, the steepness or the sheet-threading speed of the hot-rolled steel sheet H is different in each of the coils.

Figure 13:
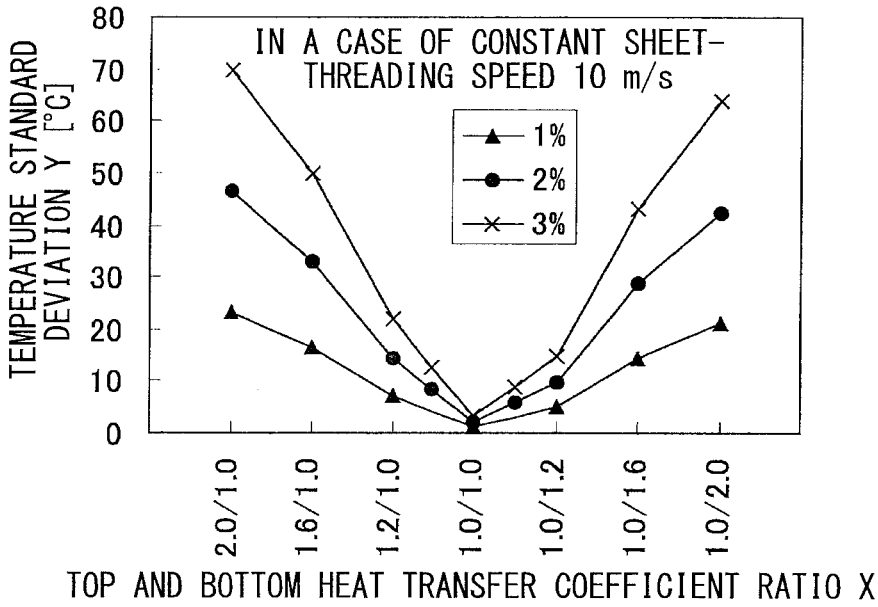
FIG. 13 is a graph illustrating the correlations between the top and bottom heat transfer coefficient ratios X and the temperature standard deviations Y which have been obtained respectively under a plurality of conditions in which the values of the steepness are different (wherein the sheet-threading speed is constant).

According to the investigation by the inventors, for example, when the steepness of the wave shape of the hot-rolled steel sheet H becomes large as illustrated in FIG. 12, the temperature standard deviation Y of the hot-rolled steel sheet H becomes large. That is, as the top and bottom heat transfer coefficient ratio X is away from "1" as illustrated in FIG. 13, the temperature standard deviation Y becomes large in accordance with the steepness (the sensitivity of the steepness). In FIG. 13, the relationship between the top and bottom heat transfer coefficient ratio X and the temperature standard deviation Y is expressed using a V-shaped regression line for each steepness as described above. Meanwhile, in FIG. 13, the sheet-threading speed of the hot-rolled steel sheet H is constant at 10 msec (600 m/min).

Figure 14:
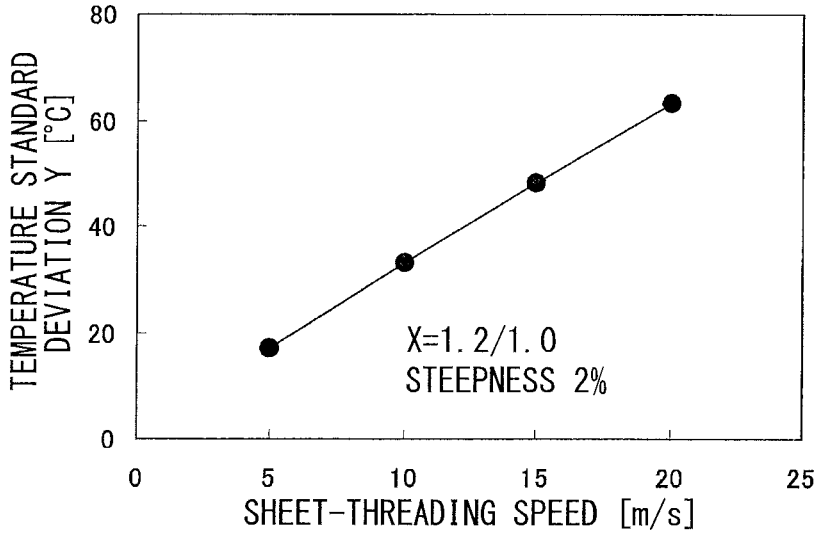
FIG. 14 is a graph illustrating the correlation between the sheet-threading speed and temperature standard deviation Y of the hot-rolled steel sheet H which have been obtained under conditions in which the top and bottom heat transfer coefficient ratio X and the steepness are set to constant values.
Figure 15:
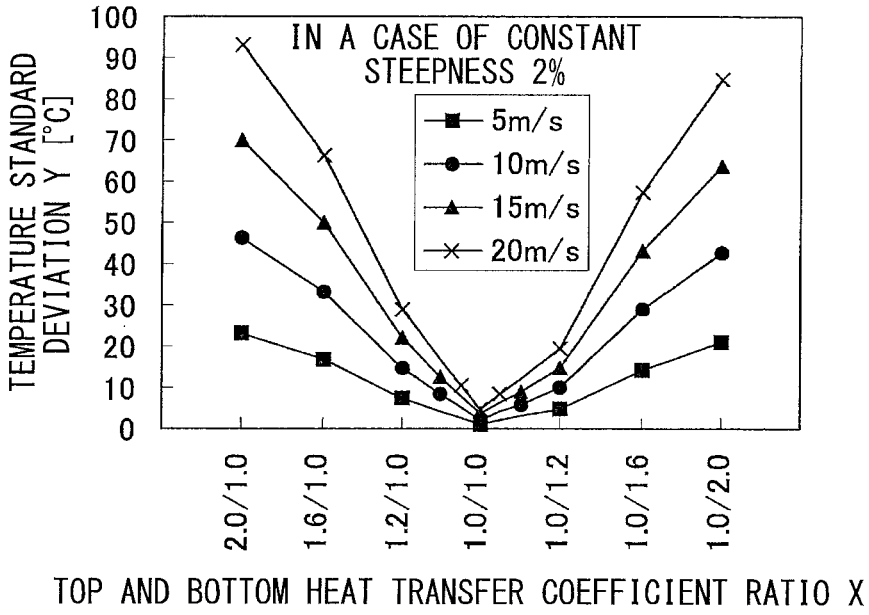
FIG. 15 is a graph illustrating the correlations between the top and bottom heat transfer coefficient ratios X and the temperature standard deviations Y which have been obtained respectively under a plurality of conditions in which the values of the sheet-threading speed are different (wherein the steepness is constant).

In addition, for example, when the sheet-threading speed of the hot-rolled steel sheet H becomes a high speed as illustrated in FIG. 14, the temperature standard deviation Y of the hot-rolled steel sheet H becomes large. That is, as the top and bottom heat transfer coefficient ratio X is away from "1" as illustrated in FIG. 15, the temperature standard deviation Y becomes large in accordance with the sheet-threading speed (the sensitivity of the sheet-threading speed). In FIG. 15, the relationship between the top and bottom heat transfer coefficient ratio X and the temperature standard deviation Y is expressed using a V-shaped regression line for each sheet-threading speed as described above. Meanwhile, in FIG. 15, the steepness of the wave shape of the hot-rolled steel sheet H is constant at 2%.

In a case in which the steepness or sheet-threading speed of the hot-rolled steel sheet H is not constant as described above, the change of the temperature standard deviation Y with respect to the top and bottom heat transfer coefficient ratio X can be qualitatively evaluated, but cannot be accurately quantitatively evaluated.

Therefore, table data indicating the correlation between each steepness and the temperature standard deviation Y of the cooled hot-rolled steel sheet H are obtained by, for example, fixing the top and bottom heat transfer coefficient ratio X of the hot-rolled steel sheet H in advance, and changing the steepness in a stepwise manner from 3% to 0% as illustrated in FIG. 12. In addition, the temperature standard deviation Y with respect to the actual steepness z % of the hot-rolled steel sheet H is corrected to the temperature standard deviation Y' with respect to a predetermined steepness using an interpolation function. Specifically, in a case in which the predetermined steepness is set to 2% as a correction condition, a temperature standard deviation Yz' is computed using the following formula (1) based on the temperature standard deviation Yz at the steepness z %. Alternatively, the temperature standard deviation Yz' may be computed by, for example, computing the gradient α of the steepness in FIG. 12 using the least squares method or the like and using the gradient α.

$$Yz' = Yz \times 2/z \tag{1}$$

In addition, in the regression formula of the V-shaped curve illustrated in FIG. 13, the steepness may be corrected to the predetermined steepness, and the temperature standard deviation Y may be derived from the regression formula. Meanwhile, Table 3 describes the temperature standard deviations Y of the hot-rolled steel sheet H in a case in which the top and bottom heat transfer coefficient ratio X is changed with respect to the steepness in FIG. 12 as illustrated in FIG. 13, values obtained by subtracting the respective temperature standard deviations Y of the hot-rolled steel sheet H by the minimum value Ymin (Ymin=1.2° C. in a case in which the steepness is 1%, Ymin=2.3° C. in a case in which the steepness is 2%, and Ymin=3.5° C. in a case in which the steepness is 3%) (the differences of the standard deviations from the minimum value), and the evaluation of the respective temperature standard deviations Y.

The indication and evaluation standards of the top and bottom heat transfer coefficient ratio X in Table 3 are the same as in the evaluation in Table 1, and thus will not be described. The temperature standard deviation Y of the hot-rolled steel sheet H in accordance with the steepness can be derived using FIG. 13 or Table 3. In addition, for example, in a case in which the steepness is corrected to 2%, it is possible to set a top and bottom heat transfer coefficient ratio X, at which the evaluation in Table 3 becomes "B", that is, the difference of the standard deviation from the minimum value of the hot-rolled steel sheet H becomes 10° C. or less, to 1.1.

TABLE 3

| Steepness (%) | Top and bottom heat transfer coefficient ratio X | Temperature standard deviation (° C.) | Difference of standard deviation from minimum value (° C.) | Evaluation |
|---|---|---|---|---|
| 1 | 1.6/1.0 | 16.6 | 15.4 | C |
| | 1.2/1.0 | 7.3 | 6.1 | B |
| | 1.0/1.0 | 1.2 | 0.0 | A |
| | 1.0/1.2 | 4.9 | 3.7 | B |
| | 1.0/1.6 | 14.4 | 13.2 | C |
| 2 | 1.6/1.0 | 33.2 | 30.9 | C |
| | 1.1/1.0 | 8.5 | 6.2 | B |
| | 1.0/1.0 | 2.3 | 0.0 | A |
| | 1.0/1.1 | 6.1 | 3.8 | B |
| | 1.0/1.6 | 28.7 | 26.4 | C |
| 3 | 1.2/1.0 | 21.9 | 18.4 | C |
| | 1.1/1.0 | 12.7 | 9.2 | B |
| | 1.0/1.0 | 3.5 | 0.0 | A |
| | 1.0/1.1 | 9.1 | 5.6 | B |
| | 1.0/1.2 | 14.7 | 11.2 | C |

Similarly, table data indicating the correlation between the sheet-threading speeds and the temperature standard deviation Y of the cooled hot-rolled steel sheet H are obtained by, for example, changing the sheet-threading speed in a stepwise manner from 5 m/sec (300 m/min) to 20 m/sec (1200 m/min) as illustrated in FIG. 14. In addition, the temperature standard deviation Y with respect to the actual sheet-threading speed v (m/sec) of the hot-rolled steel sheet H is corrected to the temperature standard deviation Y' with respect to a predetermined sheet-threading speed using an interpolation function. Specifically, in a case in which the predetermined sheet-threading speed is set to 10 (m/sec) as a correction condition, a temperature standard deviation Yv' is computed using the following formula (2) based on the temperature standard deviation Yv at the sheet-threading speed v (m/sec). Alternatively, the temperature standard deviation Yv' may be computed by, for example, computing the gradient β of the sheet-threading speed in FIG. 14 using the least squares method or the like and using the gradient β.

$$Yz' = Yv \times 10/v \quad (2)$$

In addition, in the regression formula of the V-shaped curve illustrated in FIG. 15, the sheet-threading speed may be corrected to the predetermined sheet-threading speed, and the temperature standard deviation Y may be derived from the regression formula. Meanwhile, Table 4 describes the temperature standard deviations Y of the hot-rolled steel sheet H in a case in which the top and bottom heat transfer coefficient ratio X is changed with respect to the sheet-threading speed in FIG. 14 as illustrated in FIG. 15, values obtained by subtracting the respective temperature standard deviations Y by the minimum value Ymin (Ymin=1.2° C. in a case in which the sheet-threading speed is 5 m/s, Ymin=2.3° C. in a case in which the sheet-threading speed is 10 m/s, Ymin=3.5° C. in a case in which the sheet-threading speed is 15 m/s, and Ymin=4.6° C. in a case in which the sheet-threading speed is 20 m/s) (the differences of the standard deviations from the minimum value), and the evaluation of the respective temperature standard deviations Y.

The indication and evaluation standards of the top and bottom heat transfer coefficient ratio X in Table 4 are the same as in the evaluation in Table 1, and thus will not be described. The temperature standard deviation Y of the hot-rolled steel sheet H in accordance with the sheet-threading speed can be derived using FIG. 15 or Table 4. In addition, for example, in a case in which the sheet-threading speed is corrected to 10 msec, it is possible to set a top and bottom heat transfer coefficient ratio X, at which the evaluation in Table 4 becomes "B", that is, the difference of the standard deviation from the minimum value of the hot-rolled steel sheet H becomes 10° C. or less, to 1.1.

TABLE 4

| Sheet-threading speed (m/s) | Top and bottom heat transfer coefficient ratio X | Temperature standard deviation Y (° C.) | Difference of standard deviation from minimum value (° C.) | Evaluation |
|---|---|---|---|---|
| 5 | 1.6/1.0 | 16.6 | 15.4 | C |
| | 1.2/1.0 | 7.3 | 6.1 | B |
| | 1.0/1.0 | 1.2 | 0.0 | A |
| | 1.0/1.2 | 4.9 | 3.7 | B |
| | 1.0/1.6 | 14.4 | 13.2 | C |
| 10 | 1.6/1.0 | 33.2 | 30.9 | C |
| | 1.1/1.0 | 8.5 | 6.2 | B |
| | 1.0/1.0 | 2.3 | 0.0 | A |
| | 1.0/1.1 | 6.1 | 3.8 | B |
| | 1.0/1.6 | 28.7 | 26.4 | C |
| 15 | 1.2/1.0 | 21.9 | 18.4 | C |
| | 1.1/1.0 | 12.7 | 9.2 | B |
| | 1.0/1.0 | 3.5 | 0.0 | A |
| | 1.0/1.1 | 9.1 | 5.6 | B |
| | 1.0/1.2 | 14.7 | 11.2 | C |
| 20 | 1.2/1.0 | 29.2 | 24.6 | C |
| | 1.05/1.0 | 10.8 | 6.2 | B |
| | 1.0/1.0 | 4.6 | 0.0 | A |
| | 1.0/1.05 | 8.4 | 3.8 | B |
| | 1.0/1.2 | 19.6 | 15.0 | C |

When the temperature standard deviation Y is corrected as described above, it is possible to accurately quantitatively evaluate the change in the temperature standard deviation Y with respect to the top and bottom heat transfer coefficient ratio X even in a case in which the steepness or sheet-threading speed of the hot-rolled steel sheet H is not constant.

In the above embodiment, the temperature and wave shape of the hot-rolled steel sheet H cooled using the cooling apparatus 14 may be measured, and the cooling capability of the top side cooling apparatus 14*a* and the cooling capability of the bottom side cooling apparatus 14*b* may be adjusted based on the measurement results. That is, the cooling capabilities of the top side cooling apparatus 14*a* and the bottom side cooling apparatus 14*b* may be feedback-controlled.

In this case, the thermometer 40 that measures the temperature of the hot-rolled steel sheet H and the shape meter 41 that measures the wave shape of the hot-rolled steel sheet H are disposed between the cooling apparatus 14 and the coiling apparatus 15 as illustrated in FIG. 16.

In addition, the temperature and shape of the hot-rolled steel sheet H in the process of sheet-threading are measured at the same point of the fixed point respectively using the thermometer 40 and the shape meter 41, and the temperature and the shape are measured as chronological data. Meanwhile, the temperature measurement area includes all the area of the hot-rolled steel sheet H in the width direction. In addition, the shape indicates the changing amount of the hot-rolled steel sheet H in the height direction observed in a measurement at the fixed point. Furthermore, similarly to the temperature measurement area, the shape measurement area includes all the area of the hot-rolled steel sheet H in the width direction. When the sampling times are multiplied by the sheet-threading speed, it becomes possible to link the chronological data of the measurement results of the temperature, changing speed and the like to the locations in the rolling direction. Meanwhile, the measurement points of the thermometer 40 and the shape meter 41 may not be strictly the same; however, in order to maintain measurement accuracy, the deviation between the measurement points of the thermometer 40 and the shape meter 41 is desirably 50 mm or less in an arbitrary direction of the rolling direction and the sheet width direction.

As described using FIGS. 8, 9, 10 and 11, in an area with a positive changing speed at the fixed point in the hot-rolled steel sheet H, in a case in which the temperature of the hot-rolled steel sheet H at the fixed point is lower than the average temperature at the fixed point, it is possible to reduce the temperature standard deviation Y by decreasing the top side cooling capability (the amount of heat dissipated from the top surface by cooling). Similarly, it is possible to reduce the temperature standard deviation Y by increasing the bottom side cooling capability (the amount of heat dissipated from the bottom surface by cooling). Use of the above relationship clarifies which cooling capability of the top side cooling apparatus 14*a* and the bottom side cooling apparatus 14*b* in the cooling apparatus 14 needs to be adjusted in order to reduce the temperature standard deviation Y.

That is, by understanding the changing location of the temperature linked to the wave shape of the hot-rolled steel sheet H, it is possible to clarify which of the top side cooling and the bottom side cooling causes the currently occurring temperature standard deviation Y. Therefore, the increase and decrease directions (control directions) of the top side cooling capability (amount of heat dissipated from the top surface by cooling) and the bottom side cooling capability (amount of heat dissipated from the bottom surface by cooling) for decreasing the temperature standard deviation Y are determined, and it is possible to adjust the top and bottom heat transfer coefficient ratio X.

In addition, it is possible to determine the top and bottom heat transfer coefficient ratio X based on the degree of the temperature standard deviation Y so that the temperature standard deviation Y converges in a permissible range, for example, a range of the minimum value Ymin to the minimum value Ymin+10° C. Since the method for determining the top and bottom heat transfer coefficient ratio X is the same as in the above embodiment described using FIGS. 6 and 7, the method will not be described in detail. Meanwhile, when the temperature standard deviation Y is converged in a range of the minimum value Ymin to the minimum value Ymin+10° C., the variations in yield stress, tensile strength and the like are suppressed within the manufacturing permissible ranges, and the hot-rolled steel sheet H can be uniformly cooled.

In addition, although there are large variations, the temperature standard deviation Y can be converged in a range of the minimum value Ymin to the minimum value Ymin+10° C. as long as a sprayed cooling water density ratio is ±5% or less with respect to the sprayed cooling water density ratio at which the temperature standard deviation Y becomes the minimum value Ymin. That is, in a case in which the sprayed cooling water density is used, the top and bottom ratio of the sprayed cooling water density (sprayed cooling water density ratio) is desirably set to ±5% or less with respect to the sprayed cooling water density ratio at which the temperature standard deviation Y becomes the minimum value Ymin. However, the permissible range does not always include the top and bottom sprayed water density.

As described above, since the cooling capabilities of the top side cooling apparatus 14*a* and the bottom side cooling apparatus 14*b* can be adjusted to be qualitatively and quantitatively appropriate cooling capabilities through feedback control, it is possible to further improve the uniformity of the hot-rolled steel sheet H which will be cooled afterwards.

Figure 17:
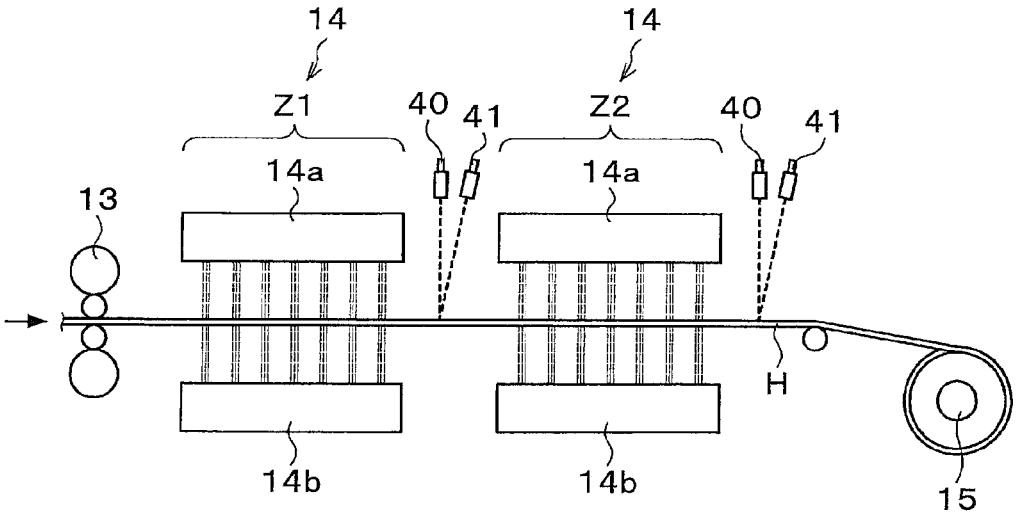
FIG. 17 is an explanatory view illustrating a modified example of the cooling apparatus 14.
Figure 18:
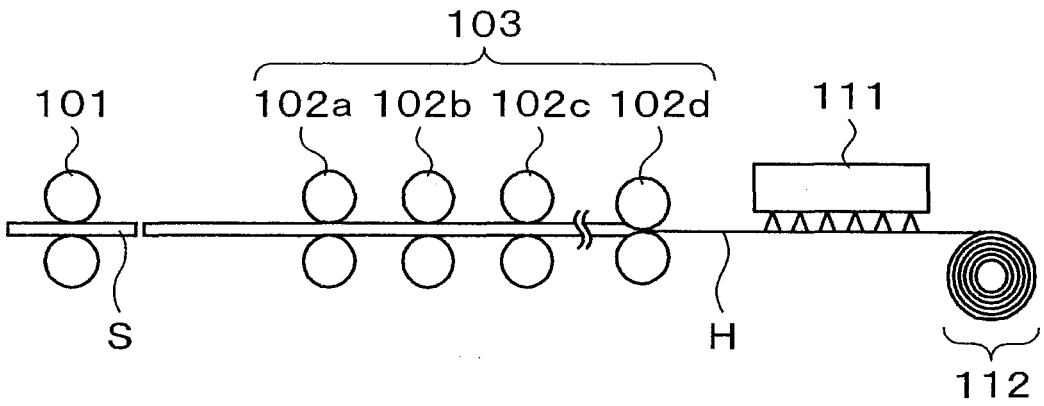
FIG. 18 is an explanatory view illustrating a method for manufacturing the hot-rolled steel sheet H of the related art.
Figure 19:
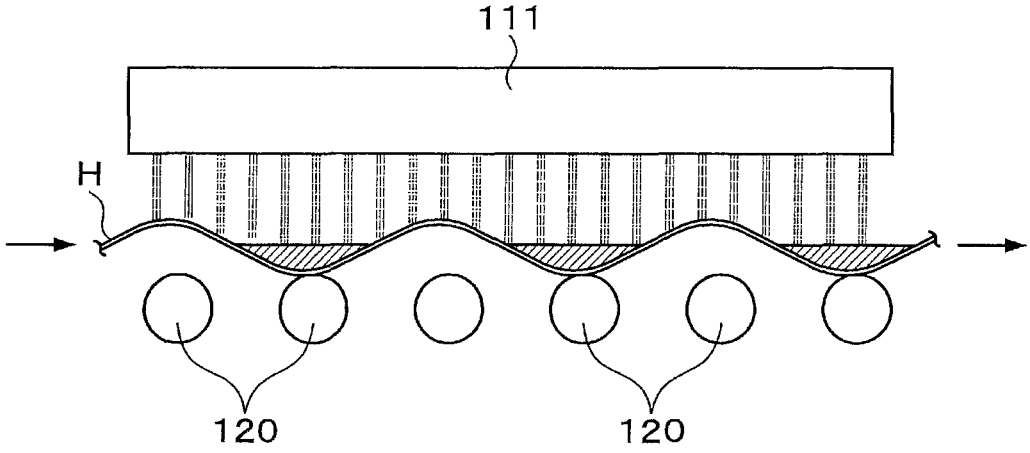
PRIOR ART FIG. 19
FIG. 19 is an explanatory view illustrating a method for cooling the hot-rolled steel sheet H of the related art.

In the above embodiment, the cooling section in which the hot-rolled steel sheet H is cooled may be divided into a plurality of sections, for example, two divided cooling sections Z1 and Z2 in the rolling direction as illustrated in FIG. 17. Each of the divided cooling sections Z1 and Z2 is provided with the cooling apparatus 14. In addition, the thermometer 40 and the shape meter 41 are provided respectively at the border between the respective divided cooling sections Z1 and Z2, that is, on the downstream side of the divided cooling sections Z1 and Z2. Meanwhile, in the embodiment, the cooling section is divided into two divided cooling sections, but the number of divisions is not limited thereto, and can be arbitrarily set. For example, the cooling section may be divided into 1 to 5 divided cooling sections.

In this case, the temperature and wave shape of the hot-rolled steel sheet H on the downstream side of the divided cooling sections Z1 and Z2 are respectively measured using the respective thermometers 40 and the respective shape meters 41. In addition, the cooling capabilities of the top side cooling apparatus 14*a* and the bottom side cooling apparatus 14*b* at the respective divided cooling sections Z1 and Z2 are controlled based on the measurement results. At this time, the cooling capabilities are controlled so that the temperature standard deviation Y of the hot-rolled steel sheet H is converged in the permissible range, for example, a range of the minimum value Ymin to the minimum value Ymin+10° C. as described above. At least one of the amount of heat dissipated from the top surface by cooling and the amount of heat dissipated from the bottom surface by cooling of the hot-rolled steel sheet H at the respective divided cooling sections Z1 and Z2 is adjusted in the above manner.

For example, in the divided cooling section Z1, the cooling capabilities of the top side cooling apparatus 14*a* and the bottom side cooling apparatus 14*b* are feedback-controlled based on the measurement results of the thermometer 40 and the shape meter 41 on the downstream side, thereby at least one of the amount of heat dissipated from the top surface by cooling and the amount of heat dissipated from the bottom surface by cooling is adjusted.

In addition, in the divided cooling section Z2, the cooling capabilities of the top side cooling apparatus 14*a* and the bottom side cooling apparatus 14*b* may be feedforward-controlled or feedback-controlled based on the measurement results of the thermometer 40 and the shape meter 41 on the downstream side. In any cases, in the divided cooling section Z2, at least one of the amount of heat dissipated from the top surface by cooling and the amount of heat dissipated from the bottom surface by cooling is adjusted.

Since the method for controlling the cooling capabilities of the top side cooling apparatus 14*a* and the bottom side cooling apparatus 14*b* based on the measurement results of the thermometer 40 and the shape meter 41 is the same as in the above embodiment described using FIGS. 8 to 11, the method will not be described in detail.

In this case, since at least one of the amount of heat dissipated from the top surface by cooling and the amount of heat dissipated from the bottom surface by cooling of the hot-rolled steel sheet H is adjusted in the respective divided cooling sections Z1 and Z2, finer control becomes possible. Therefore, it is possible to more uniformly cool the hot-rolled steel sheet H.

In the above embodiment, in the respective divided cooling sections Z1 and Z2, when adjusting at least one of the amount of heat dissipated from the top surface by cooling and the amount of heat dissipated from the bottom surface by cooling of the hot-rolled steel sheet H, at least one of the steepness of the wave shape and the sheet-threading speed of the hot-rolled steel sheet H may be used in addition to the measurement results of the thermometer 40 and the shape meter 41. In this case, the temperature standard deviation Y of the hot-rolled steel sheet H in accordance with at least the steepness or the sheet-threading speed is corrected using the same method as in the above embodiment described using FIGS. 12 to 15. In addition, at least one of the amount of heat dissipated from the top surface by cooling and the amount of heat dissipated from the bottom surface by cooling of the hot-rolled steel sheet H in the respective divided cooling sections Z1 and Z2 is corrected based on the corrected temperature standard deviation Y (Y'). Thereby, it is possible to more uniformly cool the hot-rolled steel sheet H.

In addition, according to the present embodiment, it becomes possible to finish the hot-rolled steel sheet H so that a uniform shape or material is formed in the sheet width direction of the hot-rolled steel sheet H as well. Since the temperature standard deviation in the hot-rolled steel sheet H in the sheet width direction is caused by the alternate occurrence of the temperature standard deviation Y in the rolling direction on the right and left sides, the temperature standard deviation Y in the sheet width direction is also reduced when the temperature standard deviation in the rolling direction is reduced. A wave shape having an amplitude changing in the sheet width direction of the hot-rolled steel sheet H is formed due to center buckle. As such, even in a case in which the wave shape having an amplitude changing in the sheet width direction is generated so as to form a temperature standard deviation in the sheet width direction, according to the above-described embodiment, it becomes possible to reduce the temperature standard deviation in the sheet width direction.

Thus far, the preferable embodiment of the present invention has been described with reference to the accompanying drawings, but the present invention is not limited to the above embodiment. It is evident that a person skilled in the art can imagine a variety of modified examples and corrected examples within the scope of ideas described in the claims, and it is needless to say that the examples belong to the technical scope of the present invention.

EXAMPLES

Example 1

The inventors used high tensile strength steel (a so-called high tensile strength steel sheet) having a sheet thickness of 2.3 mm and a sheet width of 1200 mm as Example 1, respectively formed a center wave shape and an edge wave shape in the material, a change in a cold-rolling gauge (change in the sheet thickness) and a change in an average temperature in a sheet width direction in a post process (that is, a cold-rolling process) were measured in a case in which the material was cooled with a variety of different values of the steepness of 0% (no wave formed) to 2%, and evaluated. Meanwhile, in Example 1 and Examples 2 and 3 to be described below, for convenience, a steepness in a case in which the center wave shape was formed was represented by −0.5% to −2%, and a steepness in a case in which the edge wave shape was formed was represented by 0.5% to 2%.

In addition, the center wave shape and the edge wave shape were measured using a commercially available shape-measuring device, the center wave shape was measured at a sheet central portion within 30 mm from a sheet center on the right and left sides, and the edge wave shape was measured at a portion 25 mm away from a sheet edge. Furthermore, in Example 1, a top and bottom cooling ratio during cooling (top and bottom heat transfer coefficient ratio) was set to top cooling: bottom cooling=1.2:1, a sheet-threading speed was set to 400 m/min, and a coiling temperature (CT) of the steel sheet was set to 500° C.

Measurement results and evaluation results are described in Table 5. At this time, as evaluation standards for the following examples, a steel sheet having a change in the cold-rolling gauge in the post process suppressed to 0 μm to 25 μm was evaluated to be A (favorable as a product), a steel sheet having the change suppressed to 25 μm to 50 μm was evaluated to be B (permissible as a product), and a steel sheet having the change of larger than 50 μm was evaluated to be C (defective as a product). Meanwhile, general evaluations in Table 5 will be described below. In addition, Table 5 also describes temperature standard deviations of the respective wave shapes in a rolling direction of the steel sheet for reference.

TABLE 5

| Steepness λ [%] | Temperature standard deviation [° C.] | Change in cold-rolling gauge [μm] | Change in average temperature in sheet width direction [° C.] | Evaluation | General evaluation |
|---|---|---|---|---|---|
| −2 | 100 | 120 | 100 | C | C |
| −1.5 | 75 | 90 | 75 | C | C |
| −1 | 50 | 60 | 50 | C | C |
| −0.5 | 25 | 30 | 25 | B | C |
| 0 | 0 | 0 | 0 | A | C |
| 0.5 | 25 | 21 | 17.5 | A | A |
| 1 | 50 | 42 | 35 | B | A |
| 1.5 | 75 | 63 | 52.5 | C | C |
| 2 | 100 | 84 | 70 | C | C |

As described in Table 5, while the change in the cold-rolling gauge in the cold-rolling process was 30 μm to 120 μm in a case in which the center wave shape was formed in the steel sheet (in the table, cases in which the steepness was −0.5% to −2%), the change in the cold-rolling gauge in the cold-rolling process was 21 μm to 84 μm in a case in which the edge wave shape was formed (in the table, cases in which the steepness was 0.5% to 2%). That is, it was found that, even when wave shapes having the same steepness were formed in the steel sheet, the change in the cold-rolling gauge (that is, the change in the sheet thickness) in the cold-rolling process was suppressed to be small in the case in which the edge wave shape was formed compared with the case in which the center wave shape was formed.

In addition, it was found from the results in Table 5 that, when the changes in the average temperature in the sheet width direction were compared between the case in which the center wave shape was formed in the steel sheet and the case in which the edge wave shape was formed, the change in the average temperature in the sheet width direction was suppressed to be small in the case in which the edge wave shape was formed compared with the case in which the center wave shape was formed in spite of the same steepness. Therefore, it was confirmed that, compared with the case in which the center wave shape was formed, in the case in which the edge wave shape was formed, temperature variation in the steel sheet width direction during cold-rolling was reduced, and variation in material qualities was suppressed.

In addition, generally, the change in the sheet thickness in the cold-rolling process of the steel sheet is desirably smaller in order to suppress a decrease in yield caused by defective products and the like. Therefore, it was found that, as described in Table 5, in a case in which the edge wave shape was formed in the steel sheet, when the steepness of the edge wave shape was set to more than 0% to 1%, the change in the cold-rolling gauge was suppressed to be a small value (for example, evaluations A and B in Table 5). Furthermore, it was found that, when the steepness of the edge wave shape was set to more than 0% to 0.5%, the change in the cold-rolling gauge was suppressed to be a smaller value (for example, the evaluation A in Table 5).

Example 2

Next, as Example 2, the inventors respectively formed a center wave shape and an edge wave shape in the same material as Example 1, a change in the cold-rolling gauge (change in the sheet thickness) and a change in the average temperature in the sheet width direction in the post process (that is, a cold-rolling process) were measured in a case in which the material was cooled with a variety of different values of the steepness of 0% (no wave formed) to 2%, and evaluated. Meanwhile, in Example 2, the sheet-threading speed was set to 600 m/min, and other conditions were set to the same conditions as Example 1. Measurement results and evaluation results are illustrated in Table 6.

TABLE 6

| Steepness λ [%] | Temperature standard deviation [° C.] | Change in cold-rolling gauge [μm] | Change in average temperature in sheet width direction [° C.] | Evaluation | General evaluation |
|---|---|---|---|---|---|
| −2 | 100 | 108 | 90 | C | C |
| −1.5 | 75 | 81 | 67.5 | C | C |
| −1 | 50 | 54 | 45 | C | C |
| −0.5 | 25 | 27 | 22.5 | B | C |
| 0 | 0 | 0 | 0 | A | C |
| 0.5 | 25 | 15 | 12.5 | A | A |
| 1 | 50 | 30 | 25 | B | A |
| 1.5 | 75 | 45 | 37.5 | B | A |
| 2 | 100 | 60 | 50 | C | C |

As described in Table 6, similarly to Example 1, it was found that, even when wave shapes having the same steepness were formed in the steel sheet, the change in the cold-rolling gauge (that is, the change in the sheet thickness) and the change in the average temperature in the sheet width direction in the cold-rolling process were suppressed to be small in the case in which the edge wave shape was formed compared with the case in which the center wave shape was formed. Additionally, as is evident from comparison between Tables 5 and 6, in Example 2, when the sheet-threading speed is set 600 m/min that was faster than that in Example 1, the change in the cold-rolling gauge and the change in the average temperature in the sheet width direction in the post process are reduced in both the case in which the center wave shape is formed and the case in which the edge wave shape is formed. That is, it was verified that, when the sheet-threading speed was set to be faster, a contact time between the steel sheet and transportation rolls became short, ununiformity of cooling due to heat dissipation by contact was alleviated so that uniform cooling was carried out, and therefore the change in the cold-rolling gauge and the change in the average temperature in the sheet width direction in the post process were further reduced.

In addition, similarly to Example 1, the change in the sheet thickness in the cold-rolling process is desirably smaller in order to suppress a decrease in yield caused by defective products and the like. Therefore, it was found that, as described in Table 6, in a case in which the edge wave shape was formed in the steel sheet, when the steepness of the edge wave shape was set to more than 0% to 1.5%, the change in the cold-rolling gauge was suppressed to be a small value (for example, evaluations A and B in Table 6). Therefore, in a case in which the sheet-threading speed was set to be fast, it is also possible to widen a control range of the edge wave shape up to 1.5%. Furthermore, it was found that, when the steepness of the edge wave shape was set to more than 0% to 0.5%, the change in the cold-rolling gauge was suppressed to be a smaller value (for example, the evaluation A in Table 6).

Example 3

Next, as Example 3, the inventors respectively formed a center wave shape and an edge wave shape in the same material as Examples 1 and 2, a change in the cold-rolling gauge (change in the sheet thickness) and a change in the average temperature in the sheet width direction in the post process (that is, a cold-rolling process) were measured in a case in which the material was cooled with a variety of different values of the steepness of 0% (no wave formed) to 2%, and evaluated. Meanwhile, in Example 3, the top and bottom cooling ratio during cooling (top and bottom heat transfer coefficient ratio) was set to top cooling: bottom cooling=1.1:1, and other conditions were set to the same conditions as Example 1. Measurement results and evaluation results are illustrated in Table 7.

TABLE 7

| Steepness λ [%] | Temperature standard deviation [° C.] | Change in cold-rolling gauge [μm] | Change in average temperature in sheet thickness direction [° C.] | Evaluation | General evaluation |
|---|---|---|---|---|---|
| 2 | 100 | 84 | 70 | C | C |
| −1.5 | 75 | 63 | 52.5 | C | C |
| −1 | 50 | 42 | 35 | B | C |
| −0.5 | 25 | 21 | 17.5 | B | C |
| 0 | 0 | 0 | 0 | A | C |
| 0.5 | 25 | 14.7 | 12.25 | A | A |
| 1 | 50 | 29.4 | 24.5 | B | A |
| 1.5 | 75 | 44.1 | 36.75 | B | A |
| 2 | 100 | 58.8 | 49 | C | C |

As described in Table 7, similarly to Example 1, it was found that, even when wave shapes having the same steepness were formed in the steel sheet, the change in the cold-rolling gauge (that is, the change in the sheet thickness) and the change in the average temperature in the sheet width direction in the cold-rolling process were suppressed to be small in the case in which the edge wave shape was formed compared with the case in which the center wave shape was formed. Additionally, as is evident from comparison between Tables 5 and 7, it was found that, when the top and bottom cooling ratio during cooling of the steel sheet was set to top cooling: bottom cooling=1.1:1, the change in the cold-rolling gauge and the change in the average temperature in the sheet width direction in the post process were reduced. That is, it was confirmed that, when the top and bottom cooling ratio during cooling of the steel sheet was approximated to 1:1, the change in the cold-rolling gauge and the change in the average temperature in the sheet width direction in the post process were further reduced.

In addition, in Example 3 as well, similarly to Example 1, the change in the sheet thickness in the cold-rolling process is desirably smaller in order to suppress a decrease in yield caused by defective products and the like. Therefore, it was found that, as described in Table 7, in a case in which the edge wave shape was formed in the steel sheet, when the steepness of the edge wave shape was set to more than 0% to 1.5%, the change in the cold-rolling gauge was suppressed to be a small value (for example, evaluations A and B in Table 7). Therefore, in a case in which the top and bottom cooling ratio during cooling of the steel sheet was set to top cooling: bottom cooling=1.1:1, it is also possible to widen a control range of the edge wave shape up to 1.5%. Furthermore, it was found that, when the steepness of the edge wave shape was set to more than 0% to 0.5%, the change in the cold-rolling gauge was suppressed to be a smaller value (for example, the evaluation A in Table 7).

Meanwhile, in Tables 5 to 7, the evaluation is A at a steepness of 0%. It is preferable that the steepness be controlled to 0% at all times, but a gain applied to the gauge change be changed at the edge wave shape and the center wave shape at a steepness of 0%. Since a control of changing the gain at all times is not preferable, hot-rolled steel sheet is desirably cooled with the steepness of the edge wave shape controlled to be more than 0%, such as 0.05% or more or 0.1% or more. Therefore, in Tables 5 to 7, the general evaluations at a steepness of 0% are C.

In addition, in Tables 5 to 7, the evaluations are B at a steepness of −0.5% or −1%. However, as described above, a steepness of −0.5% or less represents a case in which the center wave shape is formed in the hot-rolled steel sheet, and it is not possible to sufficiently suppress the change in the cold-rolling gauge in the post process. Therefore, in Tables 5 to 7, the general evaluations at a steepness of −0.5% or less are C.

INDUSTRIAL APPLICABILITY

The invention is useful when cooling a hot-rolled steel sheet which has been hot-rolled using a finishing mill so as to have a wave shape having a surface height changing in the rolling direction.

DESCRIPTION OF REFERENCE NUMERALS AND SIGNS

1: HOT ROLLING FACILITY
11: HEATING FURNACE
12: ROUGHING MILL
12*a*: WORK ROLL
12*b*: FOURFOLD MILL
13: FINISHING MILL
13*a*: FINISH-ROLLING ROLL
14: COOLING APPARATUS
14*a*: TOP SIDE COOLING APPARATUS
14*b*: BOTTOM SIDE COOLING APPARATUS
15: COILING APPARATUS
16: WIDTH-DIRECTION MILL
31: COOLING HOLE
32: TRANSPORTATION ROLL
40: THERMOMETER
41: SHAPE METER
H: HOT-ROLLED STEEL SHEET
S: SLAB
Z1, Z2: DIVIDED COOLING SECTION

The invention claimed is:

1. A method for manufacturing a steel sheet, comprising:

a hot-rolling process in which a steel material is hot-rolled using a finishing mill so as to obtain a hot-rolled steel sheet having an edge wave shape with a wave height periodically changing in a rolling direction; and a cooling process in which the hot-rolled steel sheet is cooled in a cooling section provided on a sheet-threading path, wherein the hot-rolling process includes:

a target steepness-setting process in which a target steepness of the edge wave shape is set based on first correlation data indicating a correlation between the steepness of the edge wave shape of the hot-rolled steel sheet and a temperature standard deviation Y of temperatures measured across a length of the hot-rolled steel sheet; and a shape-controlling process in which operation parameters of the finishing mill are controlled so as to match the steepness of the edge wave shape with the target steepness, wherein the cooling process includes:

a target ratio-setting process in which a heat transfer coefficient ratio X1 is set as a target ratio Xt based on second correlation data indicating a correlation between a top and bottom heat transfer coefficient ratio X and the temperature standard deviation Y; and a cooling control process in which at least one of an amount of heat dissipated from a top surface by cooling and an amount of heat dissipated from a bottom surface by cooling of the hot-rolled steel sheet in the cooling section is controlled so that heat transfer coefficient ratio X matches the target ratio Xt, wherein the method further comprising:

a temperature-measuring process in which a temperature of the hot-rolled steel sheet is measured in chronological order on a downstream side of the cooling section;

a changing speed-measuring process in which a changing speed of the hot-rolled steel sheet in a vertical direction is measured in chronological order at a same place as a temperature measurement place of the hot-rolled steel sheet on the downstream side of the cooling section;

a control direction-determining process in which, when an upward side of the vertical direction of the hot-rolled steel sheet is set as positive, in an area with a positive changing speed, in a case in which a temperature of the hot-rolled steel sheet is lower than an average temperature in a range of one or more cycles of a wave shape of the hot-rolled steel sheet, at least one of a direction in which the amount of heat dissipated from the top surface by cooling decreases and a direction in which the amount of heat dissipated from the bottom surface by cooling increases is determined as a control direction, in a case in which the temperature of the hot-rolled steel sheet is higher than the average temperature, at least one of a direction in which the amount of heat dissipated from the top surface by cooling increases and a direction in which the amount of heat dissipated from the bottom surface by cooling decreases is determined as the control direction, in an area with a negative changing speed, in a case in which the temperature of the hot-rolled steel sheet is lower than the average temperature, at least one of a direction in which the amount of heat dissipated from the top surface by cooling increases and a direction in which the amount of heat dissipated from the bottom surface by cooling decreases is determined as the control direction, and, in a case in which the temperature of the hot-rolled steel sheet is higher than the average temperature, at least one of a direction in which the amount of heat dissipated from the top surface by cooling decreases and a direction in which the amount of heat dissipated from the bottom surface by cooling increases is determined as the control direction; and an amount of heat dissipated by cooling-adjusting process in which at least one of the amount of heat dissipated from the top surface by cooling and the amount of heat dissipated from the bottom surface by cooling of the hot-rolled steel sheet in the cooling section is adjusted based on the control direction determined in the control direction-determining process, wherein:

heat transfer coefficient X is a ratio of heat transfer coefficients of top and bottom surfaces of the hot-rolled steel sheet, temperature standard deviation Y is the temperature standard deviation during or after cooling of the hot-rolled steel sheet under conditions in which steepness and sheet-threading speed of the hot-rolled steel sheet are constant values, and heat transfer coefficient X1 is a top and bottom heat transfer coefficient ratio at which the temperature standard deviation Y becomes a minimum value Ymin.

2. The method for manufacturing a steel sheet according to claim 1, wherein the cooling section is divided into a plurality of divided cooling sections in a sheet-threading direction of the hot-rolled steel sheet, the temperature and the changing speed of the hot-rolled steel sheet are measured in chronological order at each of borders of the divided cooling sections in the temperature-measuring process and the changing speed-measuring process, increase and decrease directions of the amounts of heat dissipated by cooling from the top and bottom surfaces of the hot-rolled steel sheet are determined for the respective divided cooling sections based on measurement results of the temperature and the changing speeds of the hot-rolled steel sheet at the respective borders of the divided cooling sections in the control direction-determining process, and feedback control or feedforward control is carried out in order to adjust at least one of the amount of heat dissipated from the top surface by cooling and the amount of heat dissipated from the bottom surface by cooling of the hot-rolled steel sheet at each of the divided cooling sections based on the control direction determined for each of the divided cooling sections in the amount of heat dissipated by cooling-adjusting process.

3. The method for manufacturing a steel sheet according to claim 2, the method further comprising:

a measuring process in which the steepness or the sheet-threading speed of the hot-rolled steel sheet is measured at each of the borders of the divided cooling sections; and an amount of heat dissipated by cooling-correcting process in which at least one of the amount of heat dissipated from the top surface by cooling and the amount of heat dissipated from the bottom surface by cooling of the hot-rolled steel sheet is corrected at each of the divided cooling sections based on measurement results of the steepness or the sheet-threading speeds.

* * * * *